US006794807B2

(12) United States Patent
Oh et al.

(10) Patent No.: US 6,794,807 B2
(45) Date of Patent: Sep. 21, 2004

(54) ELECTRON GUN FOR CATHODE RAY TUBE

(75) Inventors: Tae-Sik Oh, Suwon (KR); Sang-Hwan Cho, Suwon (KR); Jeong-Nam Kim, Gunpo (KR); Eui-Jeong Hwang, Yongin (KR); Bok-Chun Yun, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 30 days.

(21) Appl. No.: 10/270,247

(22) Filed: Oct. 15, 2002

(65) Prior Publication Data

US 2003/0071558 A1 Apr. 17, 2003

(30) Foreign Application Priority Data

Oct. 15, 2001 (KR) ..... 2001-63448
Oct. 17, 2001 (KR) ..... 2001-64092
Oct. 17, 2001 (KR) ..... 2001-64093
Apr. 10, 2002 (KR) ..... 2002-19558

(51) Int. Cl.[7] ..... H01J 29/50; H01J 29/46

(52) U.S. Cl. ..... 313/411; 313/414; 313/449; 315/382.1

(58) Field of Search ..... 313/409, 417, 313/411–414, 441, 444, 446–456; 315/3, 15, 382.1, 581

(56) References Cited

U.S. PATENT DOCUMENTS 2,902,623 A * 9/1959 Knechtli ..... 315/15
4,271,374 A 6/1981 Kimura
4,623,819 A * 11/1986 Janko et al. ..... 313/432
5,404,071 A * 4/1995 Son ..... 313/414
6,265,819 B1 * 7/2001 Satou et al. ..... 313/417
6,472,808 B1 * 10/2002 Uchida et al. ..... 313/414
6,541,903 B1 * 4/2003 Kagabu et al. ..... 313/421
6,570,349 B2 * 5/2003 Kimiya et al. ..... 315/382
2002/0030430 A1 * 3/2002 Miyagawa et al. ..... 313/414

FOREIGN PATENT DOCUMENTS

JP 53-76737 7/1978
JP 6-203766 7/1994
JP 8-212947 8/1996
JP 9-259797 10/1997

* cited by examiner

*Primary Examiner*—Vip Patel
*Assistant Examiner*—German Colón
(74) *Attorney, Agent, or Firm*—Robert E. Bushnell, Esq.

(57) ABSTRACT

An electron gun for a cathode ray tube includes a single cathode that emits thermions; first and second electrodes; a plurality of focus electrodes provided consecutively after the second electrode; an anode electrode mounted after a final focus electrode; and a support that supports the electrodes in an aligned configuration. The final focus electrode and the anode electrode are mounted opposing one another with a predetermined gap therebetween. If a lengthwise direction of phosphor layers forming a phosphor screen of the cathode ray tube is a Y axis direction, and a direction perpendicular to the Y axis direction is an X axis direction, an electron beam aperture formed in a portion of the final focus electrode opposing the anode electrode, and an electron beam aperture formed in the anode electrode have diameters in the X axis direction that are larger than corresponding diameters of electron beam apertures formed in the remaining electrodes.

46 Claims, 20 Drawing Sheets

ELECTRON GUN FOR CATHODE RAY TUBE

CLAIM OF PRIORITY

This application makes reference to, incorporates the same herein, and claims all benefits accruing under 35 U.S.C. §119 from applications for ELECTRON GUN FOR CATHODE RAY TUBE earlier filed in the Korean Industrial Property Office on Oct. 15, 2001 and there duly assigned Serial No. 2001-63448, for ELECTRON GUN FOR CATHODE RAY TUBE earlier filed in the Korean Industrial Property Office on Oct. 17, 2001 and there duly assigned Serial No. 2001-64092, for ELECTRON GUN FOR CATHODE RAY TUBE filed in the Korean Industrial Property Office on Oct. 17, 2001 and there duly assigned Serial No. 2001-64093, and for ELECTRON GUN FOR CATHODE RAY TUBE earlier filed in the Korean Industrial Property Office on Apr. 10, 2002 and there duly assigned Serial No. 2002-19558.

BACKGROUND OF THE INVENTION

1. Technical Field

The present invention relates to an electron gun for a cathode ray tube. More particularly, the present invention relates to an electron gun that may be applied to a cathode ray tube which requires electron beams of an extremely minute (small) spot size.

2. Related Art

In general, a cathode ray tube needs an electron gun capable of optimizing the diameter of an electron beam spot striking against a phosphor screen for improving a resolution characteristic.

For example, in the beam index cathode ray tube (CRT), which is one type of CRT, since color images are realized without the use of a shadow mask that performs color separation of the electron beams as in conventional CRTs, it is necessary in the beam index CRT for the electron gun to emit electron beams having a cross section that is within specific dimensional limits. That is, with reference to FIG. 38, so that an electron beam E/B landing on a phosphor screen 1 selectively illuminates only a desired phosphor layer 3, it is necessary that a spot formed by the landing of the electron beam E/B is substantially elliptical with a vertical major axis (i.e., major axis corresponding to the Y axis in the drawing) and a minor axis (in an X axis direction in the drawing) of a minimal length. In particular, a minor axis length (r) of the electron beam spot must be smaller than the sum of a width w1 of one phosphor layer 3 and widths w2 of black matrix regions 5 on both sides of the same phosphor layer 3 to prevent the landing of the electron beam E/B on a phosphor layer 7 of a different color.

Therefore, when compared to conventional CRTs that use a shadow mask, the beam index CRT must realize a beam diameter in the horizontal direction of the phosphor screen that is as small as possible.

Japanese Laid-Open Patent No. Sho 53-76737 by Shimoma discloses an electron gun having a first grid electrode with an elliptical aperture having a vertical major axis and a second grid electrode with an elliptical aperture having a horizontal major axis. Further, Japanese Laid-Open Patent No. Heisei 6-203766 by Yanai discloses an electron gun used in a color image receiving tube, in which apertures formed in first and second grid electrodes are elliptical with a vertical major axis and having a ratio of the major axis to the minor axis of 1.2~4.5.

In addition, Japanese Laid-open Patent No. Heisei 8-212947 by Iguchi et al. discloses an electron gun, in which a pair of electromagnetic quadruple poles and/or electrostatic quadruple poles are formed in a main focus lens region at a location where the main lens is formed or in a direction toward a cathode with respect to the main lens. Also, Japanese Laid-Open Patent No. Heisei 9-259797 by Iguchi et al. discloses an electron gun in which a trajectory of electron beams is controlled by an octuple pole electron lens means.

In the above configurations, by improving electron beam apertures formed in the first and second grid electrodes or by installing quadruple or octuple poles that influence the trace of electron beams, electron beam spots of an elliptical shape with a vertical major axis are realized at the center of the screen, and focus characteristics are improved by rotating the electron beams at circumferential areas of the screen.

However, with the use of the above electron guns, a structure to interconnect a focus electrode and an anode electrode, which form a main lens, is such that the spot size of the electron beam landing on the phosphor screen is increased (i.e., the minor axis of the elliptical electron beam spot, which has a vertical major axis, is increased) in the case where a cathode current is increased to realize bright pictures such as a snowy scene or a picture that displays characters on a white background. Spherical aberration caused as a result increases the spot size of the electron beams landing on the phosphor screen. If such electron beams are used in a beam index CRT, unintended phosphor layers of different colors are illuminated by the increased spot size of the electron beams such that picture quality significantly deteriorates.

U.S. Pat. No. 4,271,374 for Electron Gun for Cathode-ray Tube by Kimura discloses an electron gun, in which part of the focus electrode, in particular, a final focus electrode opposing an anode electrode is positioned within the anode electrode such that an aperture of a main lens is optimized. Therefore, spherical aberration initiated in the main lens is decreased to thereby minimize the spot size of the electron beams landing on the phosphor screen.

However, with the overlapping of the final focus electrode and the anode electrode in this electron gun, the aperture of the main lens formed between the final focus electrode and the anode electrode is enlarged such that while a small beam diameter may be realized, the structure of electrodes forming the main lens is complicated and difficult to manufacture. Also, because of this overlapping structure of the electrodes, internal voltage characteristics deteriorate such that a voltage difference between the final focus electrodes and the anode electrode cannot be increased.

In addition, with the overlapping structure of the final focus electrode and the anode electrode, in the case where a frequency of a deflection device is increased or a separate secondary coil is mounted to an external circumference of the panel or neck between the electron gun and deflection device to control focus characteristics and a deflection linearity of the electron beams, eddy currents are generated where the electrodes overlap. As a result, a control sensitivity of the electron beams is decreased.

SUMMARY OF THE INVENTION

It is therefore an object of the present invention to provide an electron gun for a cathode ray tube, in which a spot size of electron beams in a horizontal direction of a phosphor screen is minimized while simplifying a structure of electrodes forming a main lens.

It is another object to provide an electron gun that is suitable for use in a beam index cathode-ray tube.

It is yet another object to provide an easy and inexpensive design and manufacture of an electron gun with a simple structure of the final focus electrode and the anode electrode, which form the main lens.

It is still another object to provide an electron gun which prevents eddy currents from generating between the final focus electrode and the anode electrode and therefore reducing the focusing characteristics caused by the eddy currents during operation.

To achieve the above and other objects, the present invention provides an electron gun for a cathode ray tube, the electron gun including a single cathode that emits thermions; first and second electrodes forming a triode structure with the cathode; a plurality of focus electrodes provided consecutively after the second electrode in a direction away from the cathode; an anode electrode mounted after a final focus electrode, which is farthest from the cathode among the focus electrodes; and a support that supports the electrodes in an aligned configuration.

The final focus electrode and the anode electrode are mounted opposing one another with a predetermined gap therebetween, and if a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode.

The electron beam aperture formed in the portion of the final focus electrode opposing the anode electrode, and the electron beam aperture formed in the area of the anode electrode opposing the final focus electrode have diameters in the X axis and Y axis directions that are larger than diameters in the X axis and Y axis directions of the electron beam apertures formed in the electrodes between the cathode and the final focus electrode.

The electron gun further includes an intermediate electrode mounted between the final focus electrode and the anode electrode with a predetermined gap between the intermediate electrode and the final focus electrode and between the intermediate electrode and the anode electrode, the intermediate electrode receiving a voltage that is greater than a voltage applied to the final focus electrode and less than a voltage applied to the anode electrode.

A diameter of an electron beam aperture formed in the intermediate electrode is larger than the diameters of the electron beam apertures formed in the electrodes between the cathode and the final focus electrode.

The voltage is applied to the intermediate electrode through a resistive member, which is mounted along a length of one side of the support and connected to the intermediate electrode and the anode electrode.

The electron gun further includes a shield cup having a main surface through which an electron beam aperture is formed, the main surface contacting the anode electrode; and a plate electrode assembly having a pair of plate electrodes that are formed at a predetermined spacing on the main surface with the electron beam aperture provided between the plate electrodes, the plate electrodes extending into the anode electrode.

The electron beam aperture formed in the first electrode is elliptical with a major axis in the Y axis direction, the electron beam aperture formed in the second electrodes is quadrilateral, and a slot is formed in a surface of the second electrode facing the focus electrodes, the slot being formed lengthwise in the X axis direction.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 6 is based on an X axis direction and FIG. 7 is based on a Y axis direction;

FIG. 33 is based on an X axis direction and FIG. 34 is based on a Y axis direction;

DETAILED DESCRIPTION OF THE PREFERRED EMBODIMENTS

Preferred embodiments of the present invention will now be described in detail with reference to the accompanying drawings.

[First Preferred Embodiment]

Figure 1:
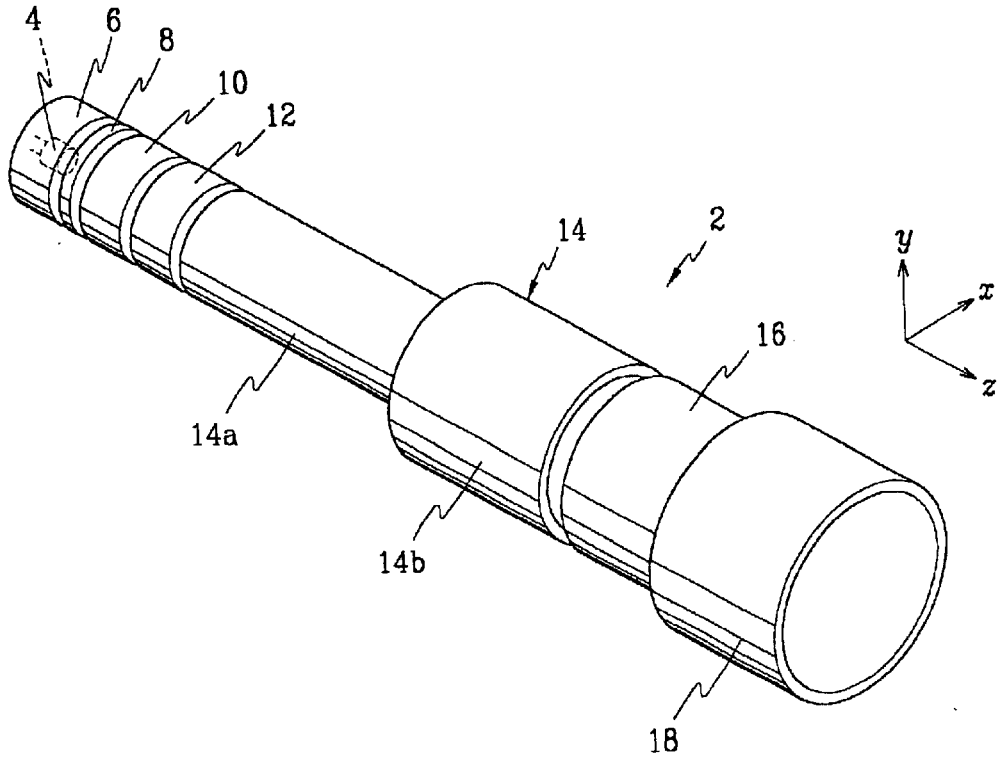
FIG. 1 is a schematic perspective view of an electron gun for a cathode ray tube according to a first preferred embodiment of the present invention.
Figure 2:
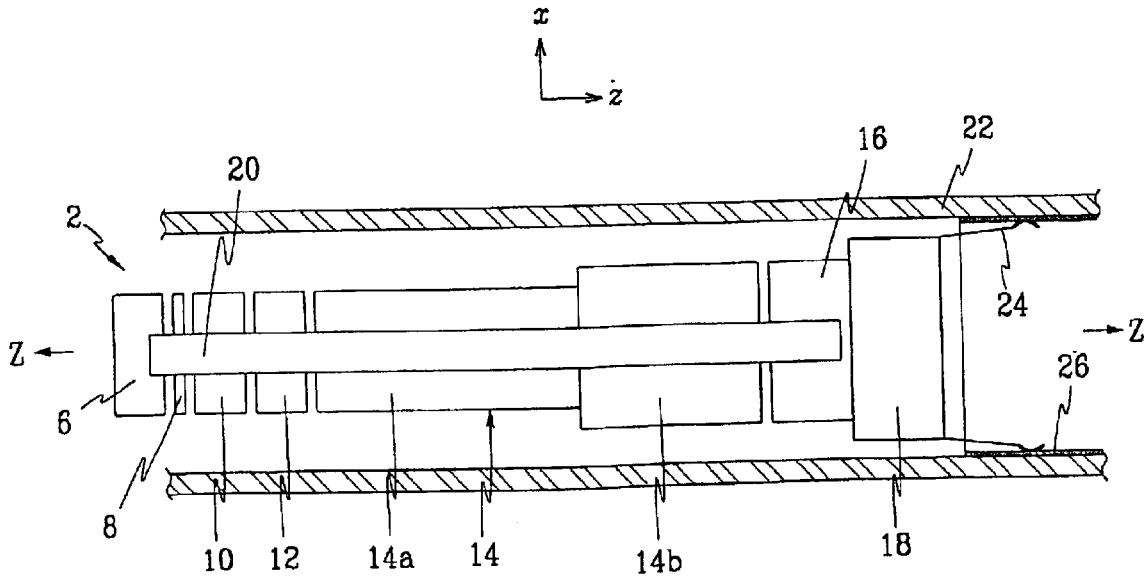
FIG. 2 is a plan view of the electron gun of FIG. 1 in a state mounted in a neck of a cathode ray tube.
Figure 3:
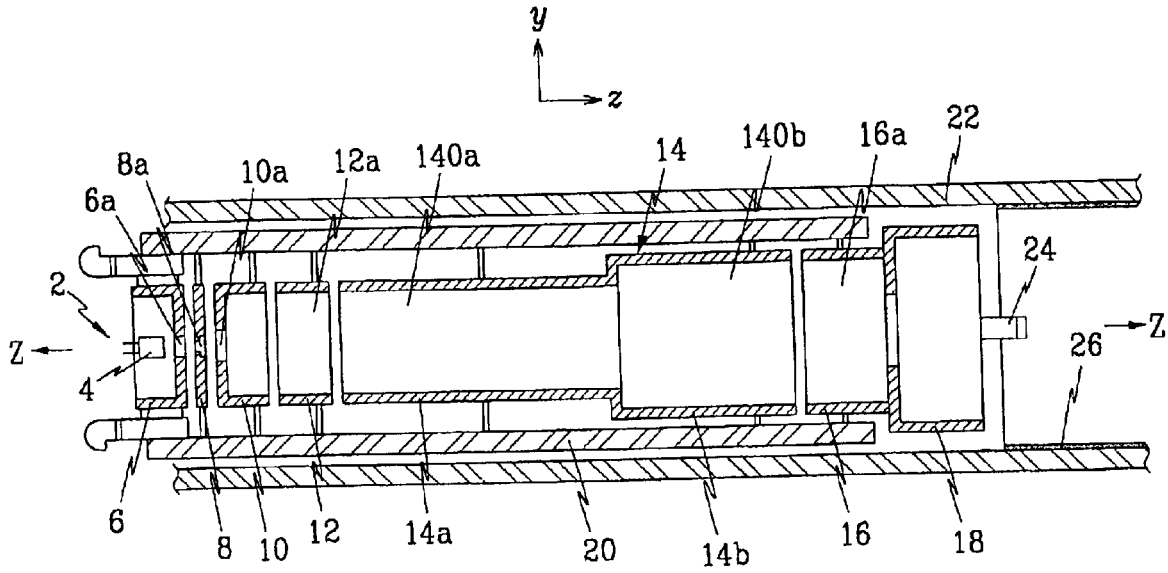
FIG. 3 is a side sectional view of the electron gun of FIG. 2.

FIG. 1 is a schematic perspective view of an electron gun for a cathode ray tube according to a first preferred embodiment of the present invention; FIG. 2 is a plan view of the electron gun of FIG. 1 in a state mounted in a neck of a cathode ray tube; and FIG. 3 is a side sectional view of the electron gun of FIG. 2. Reference numeral 2 in the drawings indicates the electron gun.

The electron gun 2 includes a single cathode 4 for emitting electrons; first and second electrodes 6 and 8 that form a triode structure with the cathode 4; a plurality of focus electrodes 10, 12, and 14 (hereinafter referred to also as the first focus electrode 10, the second focus electrode 12, and the final focus electrode 14, respectively), which are provided consecutively in this sequence following the second electrode 8 and moving toward a positive Z axis direction in the drawings; an anode electrode 16 positioned subsequent to the final focus electrode 14 in the positive Z axis direction; and a shield cap 18 mounted on the anode electrode 16 on an end thereof opposite an end adjacent to the final focus electrode 14. The electrodes 6, 8, 10, 12, 14, and 16 are supported on a support member 20, which is made of bead glass, in such a manner to be aligned in the Z axis direction.

The electron gun 2 structured as in the above is fixedly (securely) mounted within a neck 22 of a CRT by a stem (not shown). Also, except for the anode electrode 16, all the electrodes 6, 8, 10, 12, and 14 are connected to a stem pin (not shown) to receive required voltages. The anode electrode 16 is electrically connected to a graphite layer 26, which is deposited on an inner surface of the neck 22, through its contact to the shield cup 18 and through a bulb spacer 24, which is fixed to the shield cup 18. A high anode voltage of approximately 25~33 kV (kilovolts) is supplied through the graphite layer 26.

In the first preferred embodiment of the present invention, the electron gun 2 includes the three focus electrodes 10, 12, and 14, and a specific voltage is applied thereto using a U-BPF (uni-bi potential focus) method to form a focus lens. However, the present invention is not limited to this number of focus electrodes or to this specific method for applying a voltage to the focus electrodes.

The structure of the electrodes 6, 8, 10, 12, 14, and 16 will be described in more detail. The first electrode 6 is cup-shaped (i.e., cylindrical and hollow with one end open and an opposing end closed) to surround the cathode 4. The second electrode 8 is plate-shaped. Electron beam apertures 6*a* and 8*a* are formed in the first electrode 6 and the second electrode 8, respectively. Centers of the electron beam apertures 6*a* and 8*a* are aligned in the Z axis direction.

The first focus electrode 10 is cup-shaped and includes an electron beam aperture 10*a* on its closed end, in which a center of the electron beam aperture 10*a* is aligned with the centers of the electron beam apertures 6*a* and 8*a* in the Z axis direction. The second focus electrode 12 and the final focus electrode 14 are cylindrical and hollow with no closed end. The second and final focus electrodes 12 and 14 have center axes that are aligned in the Z axis direction and have predetermined inner and outer diameters. The second focus electrode 12 defines a cylindrical electron beam aperture 12*a* such that a diameter of the electron beam aperture 12*a* corresponds to an inner diameter of the second focus electrode 12, and the final focus electrode 14 defines cylindrical electron beam apertures 140*a* and 140*b* such that diameters of the electron beam apertures 140*a* and 140*b* correspond to inner diameters of the final focus electrode 14.

That is, with respect to the final focus electrode 14, this electrode 14 includes an input section 14*a* adjacent to the second focus electrode 12 and an output section 14*b* adjacent to the anode electrode 16. The input section 14*a* and the output section 14*b* are integrally formed and have predetermined lengths along the Z axis direction. Further, the input section 14*a* has a smaller outer circumference than the output section 14*b* such that the electron beam apertures 140*a* and 140*b* defined by the input and output sections 14*a* and 14*b*, respectively, have different diameters.

In addition, the final focus electrode 14 and the anode electrode 16 are provided with a predetermined gap (in the Z axis direction) therebetween. The anode electrode 16 is cylindrical and hollow to define an electron beam aperture 16*a*. The electron beam aperture 16*a* of the anode electrode 16 and the electron beam aperture 140*b* of the output section 14*b* of the final focus electrode 14 have diameters that are larger than the electron beam apertures of all the other electrodes between the cathode 4 and the output section 14*b* of the final focus electrode 14. In more detail, the diameters of the electron beam apertures 140*b* and 16*a* respectively of the output section 14*b* of the final focus electrode 14 and the anode electrode 16 are not only larger than the electron beam apertures 6*a*, 8*a*, 10*a*, and 12*a* of the first electrode 6, the second electrode 8, the first focus electrode 10, and the second focus electrode 12, respectively, but are also larger than the diameter of the electron beam aperture 140*a* of the input section 14*a* of the final focus electrode 14.

If it is assumed that in a CRT to which the electron gun 2 is applied, a lengthwise direction of phosphor layers forming a phosphor screen corresponds to a Y axis direction, and an X axis direction is perpendicular to the Y axis direction, it is possible for the diameters of the electron beam apertures 140*a* and 16*a* to be larger than the diameters of the other electron beam apertures in only the X axis direction. It is also possible for the diameters of the electron beam apertures 140*a* and 16*a* to be larger than the diameters of the other electron beam apertures in both the X axis and Y axis directions.

In the first preferred embodiment of the present invention, cross sections of the electron beam apertures 6*a*, 8*a*, 10*a*, 12*a*, 140*a*, 140*b*, and 16*a* in the X-Y plane are circular, that is, diameters for each in the X axis and Y axis directions are identical, and the diameters of the electron beam apertures 140*a* and 16*a* are larger than the diameters of the other electron beam apertures in both the X axis and Y axis directions.

Figure 4:
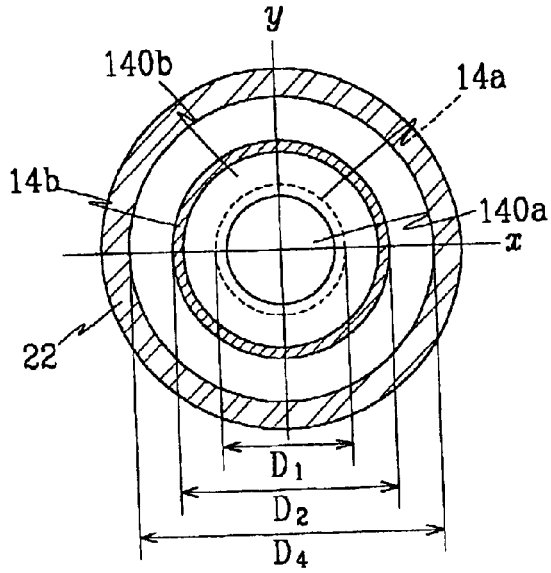
FIG. 4 is a sectional view of the electron gun of FIG. 1 used for illustrating a relation between input and output sections of a final focus electrode.
Figure 5:
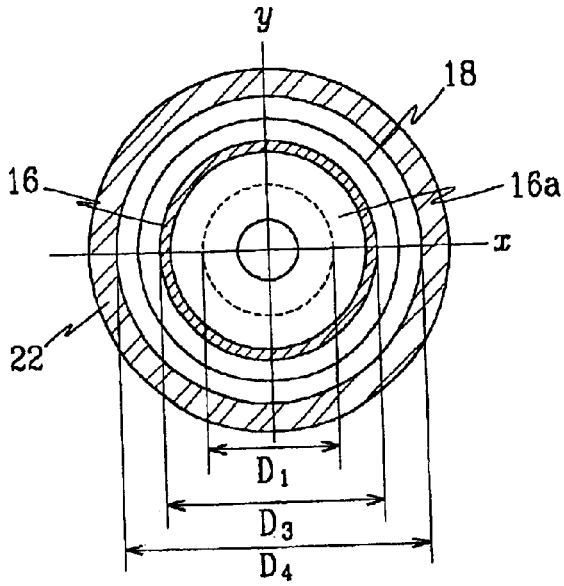
FIG. 5 is a sectional view of the electron gun of FIG. 1 used for illustrating a relation between an anode electrode and an input section of a final focus electrode.

If an outer diameter of the input section 14*a* of the final focus electrode 14 is $D_1$, an outer diameter of the output section 14*b* of the final focus electrode is $D_2$, an outer diameter of the anode 8 electrode 16 is $D_3$, and an inner diameter of the neck 22 is $D_4$, the following relations between these diameters are satisfied (refer to FIGS. 4 and 5).

$$D_1<D_2<D_4 \quad (1)$$

$$D_1<D_3<D_4 \quad (2)$$

Therefore, in the first preferred embodiment of the present invention, the final focus electrode 14 and the anode electrode 16 are cylindrical having outer diameters and electron beam apertures that are bigger than those of the other electrodes. Also, the final focus electrode 14 is formed including the input section 14*a* and the output section 14*b*, in which the outer diameter of the output section 14*b* is larger than that of the input section 14*a*. At this time, it is preferable that $D_2$ and $D_3$ are identical.

In order to ensure a minimum extra space so that the electron gun 2 is mounted in a suitable manner in the neck 22, that is, a minimum extra space so that the support member 20 is mounted in a suitable manner with respect to the inner circumference of the neck 22 and the electrodes, it is preferable that $D_2$ and $D_3$ satisfy the following conditions, which state that $D_2$ and $D_3$ are 65% or less than $D_4$.

$$D_2<0.65\times D_4 \quad (3)$$

$$D_3<0.65-D_4 \quad (4)$$

The minimum extra space concerns a space between the support member and the inner surface of the neck when the electron gun is mounted in the inner circumference of the neck. The conditions mentioned in equations (3) and (4) above show a relationship between $D_2$ and $D_4$ or $D_3$ and $D_4$ such that the electron gun is mounted in a suitable manner without the support member being in contact with the inner surface of the neck. If $D_2$ and $D_4$ or $D_3$ and $D_4$ do not satisfy the conditions of equations (3) and (4) above for example because the final focus electrode or the anode electrode becomes bigger than an optimal state, it is difficult to install the electron gun within the neck.

Figure 6:
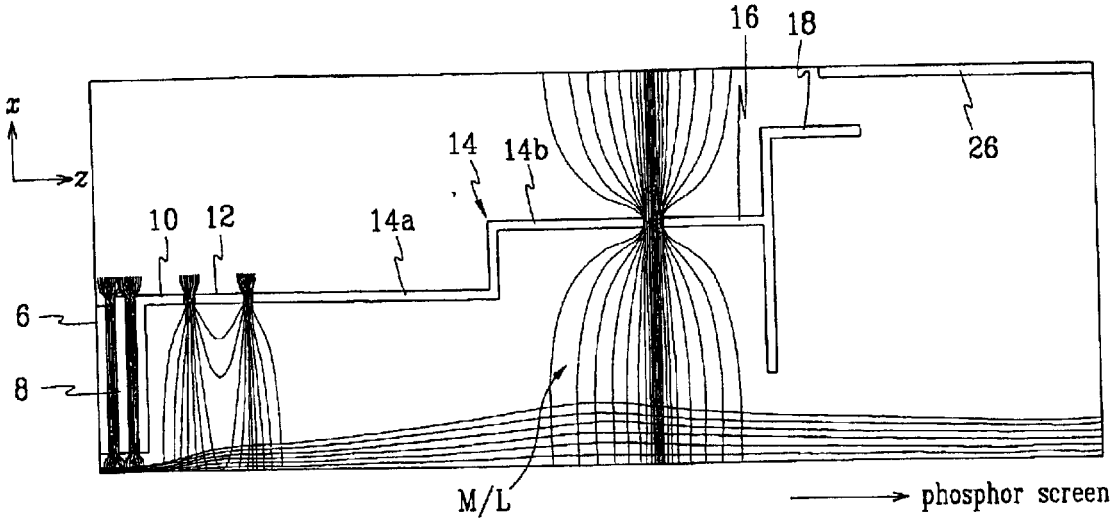
FIGS. 6 and 7 show results of a simulation indicating equipotential lines distributed on each electrode of an electron gun and indicating electron beam trajectory according to a first preferred embodiment of the present invention, where
Figure 7:
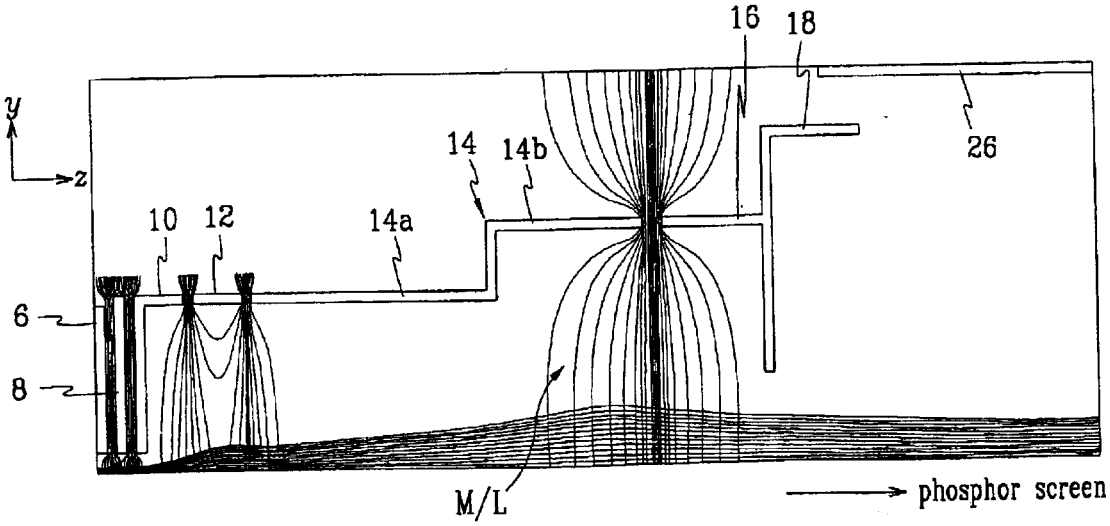

FIGS. 6 and 7 show results of a simulation indicating equipotential lines distributed on each electrode of the electron gun 2 and indicating electron beam trajectory according to the first preferred embodiment of the present invention, where FIG. 6 is based on the X axis direction and FIG. 7 is based on the Y axis direction.

With reference to the drawings, the electron beam aperture 140*b* of the output section 14*b* of the final focus electrode 14 and the electron beam aperture 16*a* of the anode electrode 16 are enlarged so that an aperture of a main lens M/L, which is formed by the output section 14*b* of the final focus electrode 14 and the anode electrode 16, is enlarged. A reduction in spherical aberration and improvement in focus characteristics are realized by increasing the aperture of the main lens M/L such that electron beams having a small spot size in the X axis direction may be formed.

Further, since the main lens M/L of a large aperture may be formed in a suitable manner as described above even without the overlapping of the final focus electrode 14 and the anode electrode 16, it is possible to avoid the generation of eddy currents, which reduce the focus characteristics of electron beams and are caused by the overlapping of these elements.

Other preferred embodiments of the present invention will now be described. In the preferred embodiments to follow, the basic structures of electron guns to be disclosed are identical to that of the first preferred embodiment of the present invention. However, electron beam apertures formed by output sections of final focus electrodes and electron beam apertures formed by anode electrodes have horizontal major axes in the X axis direction.

[Second Preferred Embodiment]

Figure 8:
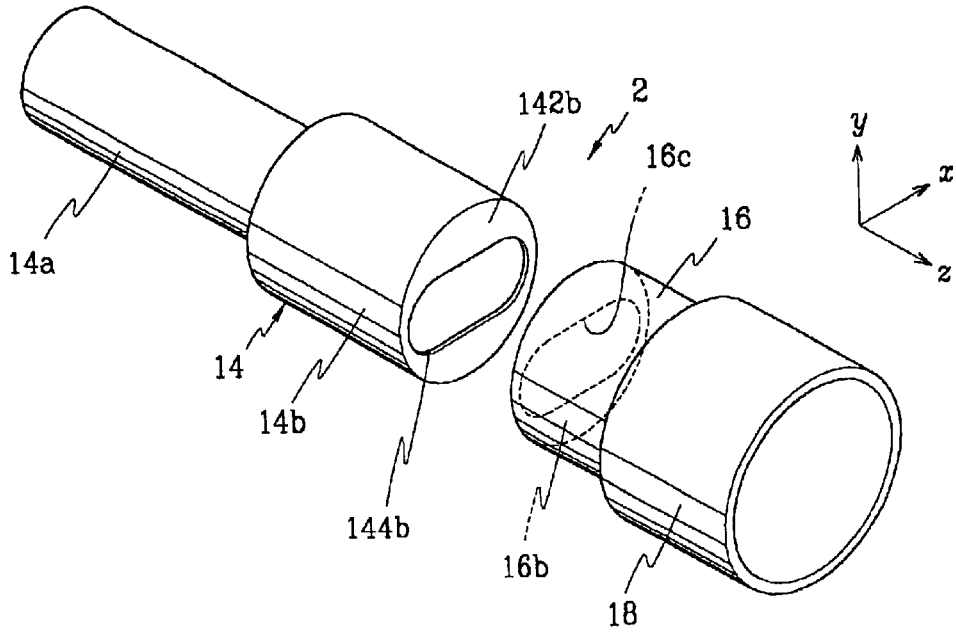
FIG. 8 is a schematic view of an electron gun for a cathode ray tube according to a second preferred embodiment of the present invention.

With reference to FIG. 8, in an electron gun 2 according to a second preferred embodiment of the present invention, a final focus electrode 14 and an anode electrode 16 are cylindrical. Rims 142*b* and 16*b* are formed on opposing ends of the final focus electrode 14 and the anode electrode 16, respectively, and electron beam apertures 144*b* and 16*c* are defined respectively by the rims 142*b* and 16*b*.

The electron beam apertures 144*b* and 16*c* are elliptical with horizontal major axes, that is, major axes in the X axis direction. Therefore, the lengths of the electron beam apertures 144*b* and 16*c* in the X axis direction are greater than the lengths in the Y axis direction.

[Third Preferred Embodiment]

Figure 9:
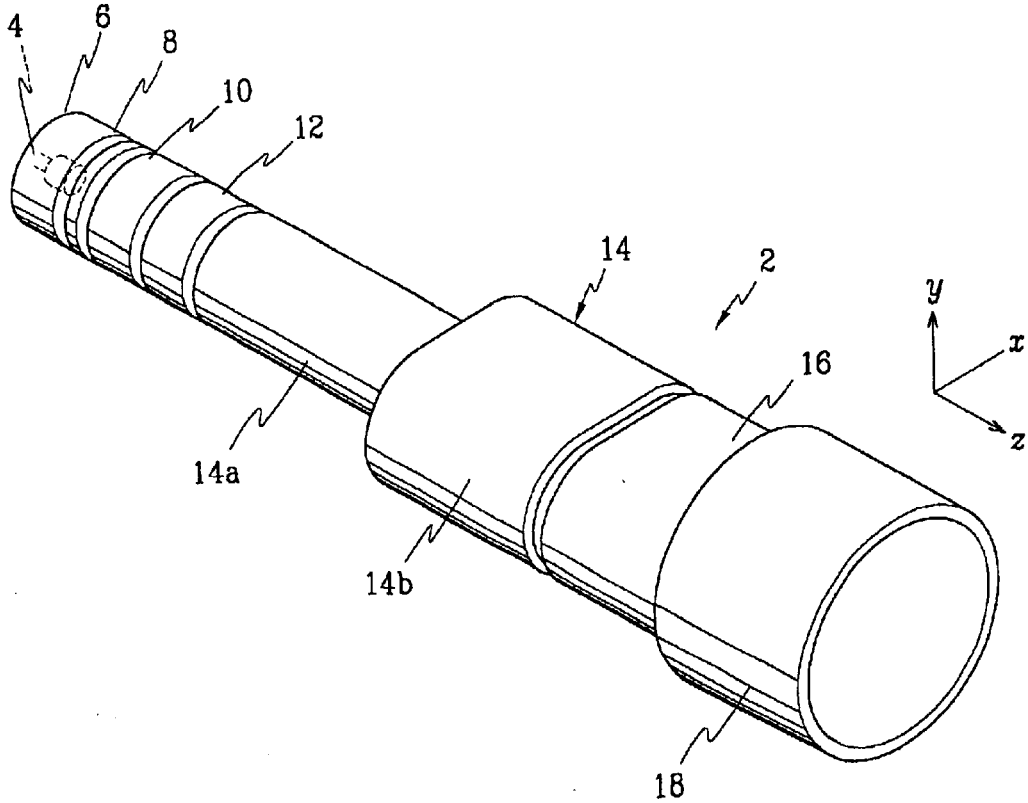
FIG. 9 is a schematic perspective view of an electron gun for a cathode ray tube according to a third preferred embodiment of the present invention.
Figure 10:
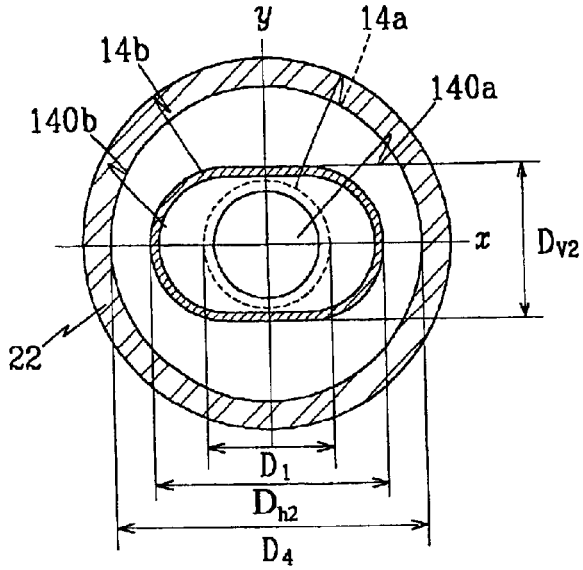
FIG. 10 is a sectional view of the electron gun of FIG. 9 used for illustrating a relation between input and output sections of a final focus electrode.
Figure 11:
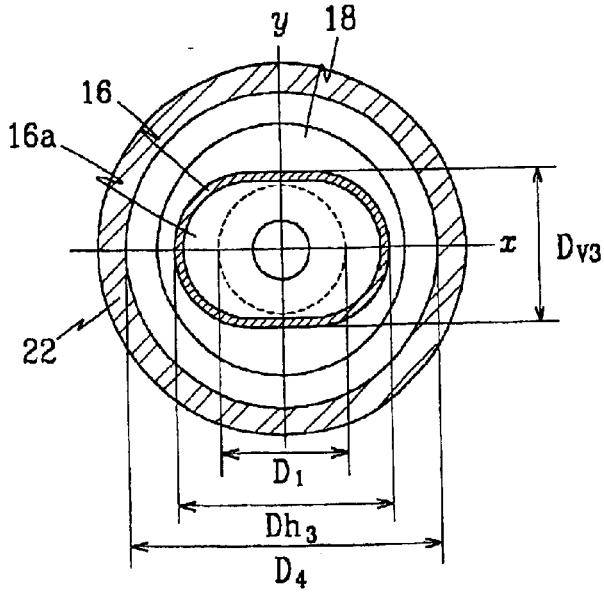
FIG. 11 is a sectional view of the electron gun of FIG. 9 used for illustrating a relation between an anode electrode and an input section of a final focus electrode.

FIG. 9 is a schematic perspective view of an electron gun for a cathode ray tube according to a third preferred embodiment of the present invention. FIGS. 10 and 11 are sectional views of the electron gun shown in FIG. 9, shown in a state where the electron gun is mounted in a neck of a CRT, where FIG. 10 is a sectional view of the electron gun of FIG. 9 used for illustrating a relation between input and output sections of a final focus electrode, and FIG. 11 is a sectional view of the electron gun of FIG. 9 used for illustrating a relation between an anode electrode and an input section of a final focus electrode.

External shapes of an output section 14*b* of a final focus electrode 14 and of an anode electrode 16, which form a main lens, are elliptical with horizontal major axes, that is, major axes in the X axis direction. With this structure, electron beam apertures 140*b* and 16*a* defined respectively by the output section 14*b* of the final focus electrode 14 and the anode electrode 16 are also elliptical with major axes in the X axis direction.

Further, with respect to the relation in sizes between an input section 14*a* and the output section 14*b* of the final focus electrode 14, the anode electrode 16, and a neck 22, the following inequality conditions are satisfied, where an outer diameter of the input section 14*a* is $D_1$, outer diameters of the output section 14*b* respectively in the X axis direction and the Y axis direction are $D_{h2}$ and $D_{v2}$, outer diameters of the anode electrode 16 respectively in the X axis direction and the Y axis direction are $D_{h3}$ and $D_{v3}$, and an inner diameter of the neck 22 is $D_4$.

$$D_1<D_{v2}<D_{h2}<D_4 \quad (5)$$

$$D_1<D_{v3}<D_{h3}<D_4 \quad (6)$$

In the above inequalities, it is preferable that $D_{v2}$ and $D_{v3}$ are substantially identical, and $D_{h2}$ and $D_{h3}$ are substantially identical.

Further, the following conditions are satisfied to ensure withstand voltage characteristics of the final focus electrode 14 and the anode electrode 16 with respect to a graphite layer deposited on an inner surface of the neck 22.

$$D_{h2} \leqq 0.95 \times D_4 \quad (7)$$

$$D_{h3} \leqq 0.95 \times D_4 \quad (8)$$

In the final focus electrode and the anode electrode as cylindrical-type electrodes shown in FIGS. 4 and 5, because an additional shape should be formed on the outer circumference of the final focus electrode and the anode electrode for withstanding voltage characteristics between the electrodes, and ensuring the minimum extra space, the $D_2$ or $D_3$ are limited as the inequalities described in equations (3) and (4).

In contrast, in the final focus electrode and the anode electrode as elliptical-type electrodes with horizontal major axes drawn in FIGS. 10 and 11, because the minimum extra space can be sufficiently ensured since it is possible for the support member to be installed on the outer circumference of the electrodes of the vertical minor axes, the upper limit of $D_{h2}$ or $D_{h3}$ as the inequalities in the equations (3) and (4) can be increased.

Further, if the rim is formed in the final focus electrode and the anode electrode, respectively, it is possible to substantially adjust the size of the apertures of the electrodes as well as strengthen an intensity of the electrode, and to ensure the withstanding of voltage characteristics between the electrodes.

[Fourth Preferred Embodiment]

Figure 12:
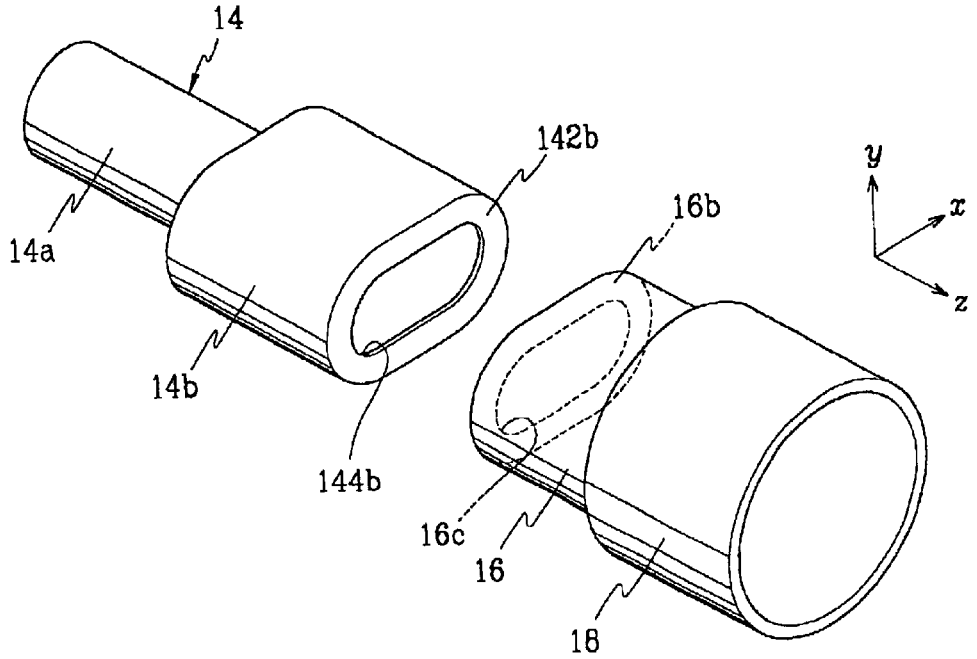
FIG. 12 is a schematic perspective view of an electron gun for a cathode ray tube according to a fourth preferred embodiment of the present invention.

FIG. 12 is a schematic perspective view of an electron gun for a cathode ray tube according to a fourth preferred embodiment of the present invention. An anode electrode 16 and an output section 14*b* of a final focus electrode 14 are elliptical with major axes in the X axis direction. Also, as in the second preferred embodiment, rims 142*b* and 16*b* are formed on opposing ends of the output section 14*b* of the final focus electrode 14 and the anode electrode 16, respectively, and electron beam apertures 144*b* and 16*c* are defined respectively in the rims 142*b* and 16*b*.

In the second, third, and fourth preferred embodiments of the present invention, the electron beam apertures formed in the output section of the final focus electrode and in the anode electrode, which include the main lens, are elliptical with major axes in the X axis direction. As a result, when the electron gun is operated and the main lens is formed between the final focus electrode and the anode electrode, the diameter of the main lens in the horizontal direction is further enlarged such that spherical aberration of the main lens (in the horizontal direction) may be additionally reduced. This enables the electron beams landing on the phosphor screen to have a minimal horizontal diameter such that landing only on intended phosphor layers occurs.

Figure 13:
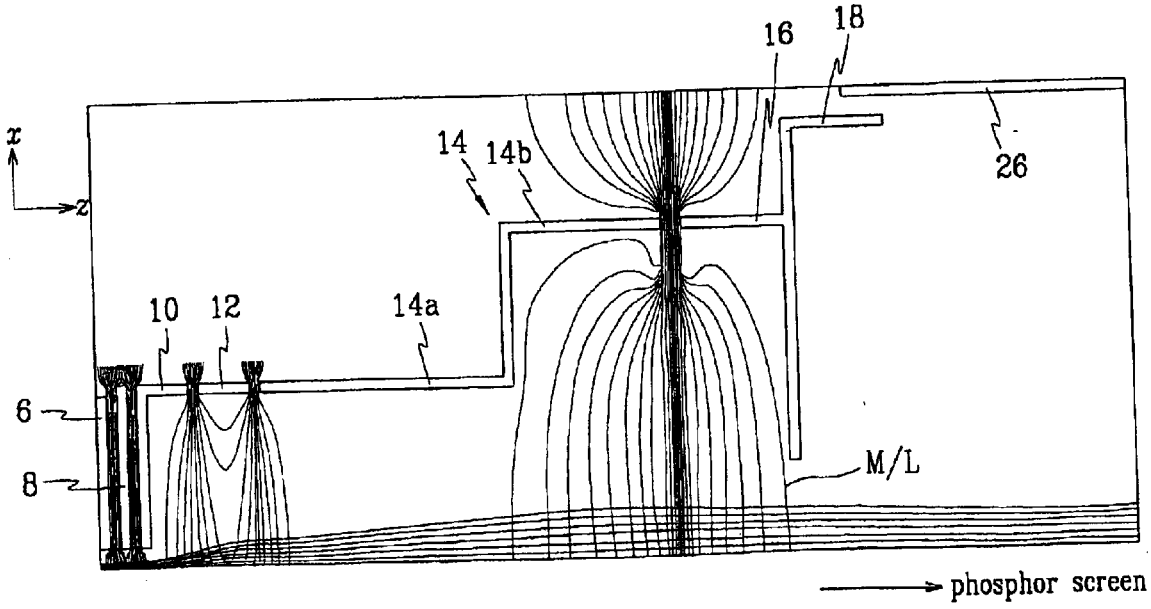
FIG. 13 shows results of a simulation indicating equipotential lines distributed on each electrode of an electron gun and indicating electron beam trajectory according to a fourth preferred embodiment of the present invention.

FIG. 13 shows results of a simulation indicating equipotential lines distributed on each electrode of the electron gun and indicating electron beam trajectory according to the fourth preferred embodiment of the present invention. The drawing is shown based on the X axis direction.

With reference to the drawing, the main lens M/L formed by the final focus electrode 14 and the anode electrode 16 is enlarged, and an aperture thereof is increased (in the horizontal, X axis direction) over the main lens of the first preferred embodiment. Therefore, spherical aberration with respect to the horizontal direction of the main lens M/L is further reduced such that the horizontal diameter of the electron beams landing on the phosphor screen is decreased to thereby land only on intended phosphor layers.

As described above, in the second, third, and fourth preferred embodiments of the present invention, the electron beam apertures formed in the output section 14*b* of the final focus electrode 14 and in the anode electrode 16 are elliptical with major axes in the X axis direction such that the spot size of the electron beams landing on the phosphor screen are further reduced. In these preferred embodiments, by adjusting vertical and horizontal length ratios of the output section of the final focus electrodes, the anode electrode, and the electron beam apertures formed in these elements, diameters of the main lens in the X and Y axes directions may be easily controlled. Therefore, the spot of the electron beams landing on the phosphor screen may be controlled to an optimal size, that is, the spot may be manipulated to a shape of an ellipse with an optimal eccentricity.

[Fifth Preferred Embodiment]

Figure 14:
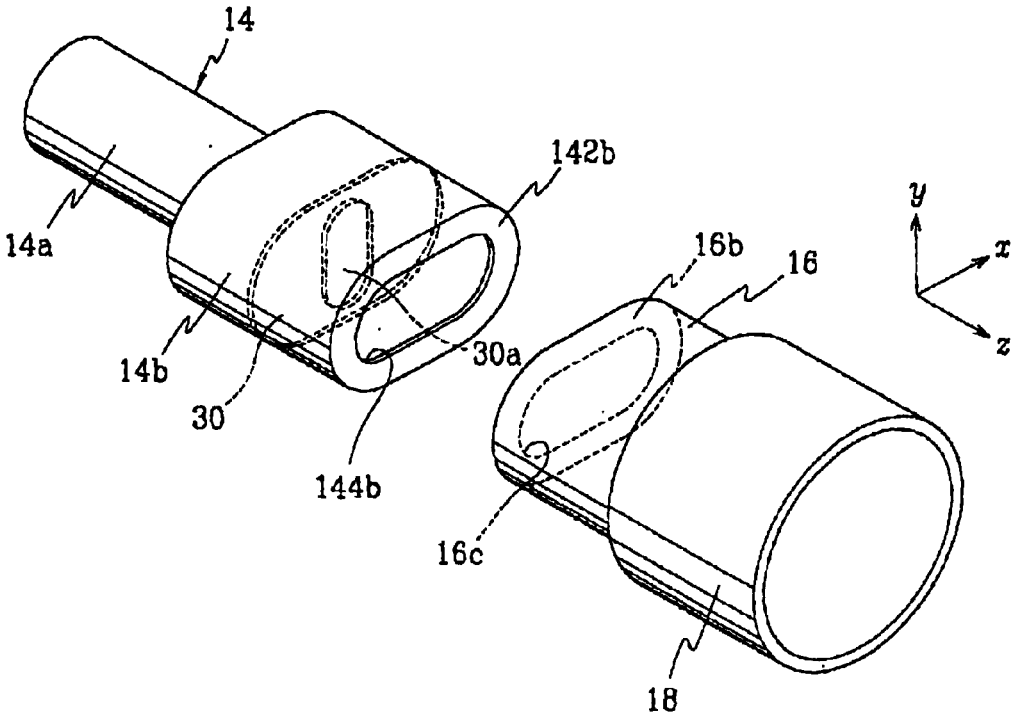
FIG. 14 is a schematic perspective view of an electron gun for a cathode ray tube according to a fifth preferred embodiment of the present invention.

FIG. 14 is a schematic perspective view of an electron gun for a cathode ray tube according to a fifth preferred embodiment of the present invention. The electron gun 2 of the fifth preferred embodiment adds to the structure of the fourth preferred embodiment, a plate-shaped auxiliary electrode 30 mounted within an output section 14*b* of a final focus electrode 14.

An electron beam aperture 30*a* is formed in the auxiliary electrode 30. The electron beam aperture 30*a* is elliptical with a major axis in the Y axis direction. With this structure, an aperture of a main lens in the Y axis direction may also be minutely adjusted to enable optimization of the aperture of the main lens.

The auxiliary electrode has a function that mainly adjusts the shape of an electron beam formed on a phosphor screen. To better explain the function, when a focusing voltage is applied to the final electrode, a voltage about the horizontal direction of the final electrode and a voltage about the vertical direction of the final electrode become different from each other because of an electron beam aperture formed in the auxiliary electrode. According to such a result, the voltage about the horizontal direction is higher than the voltage about the vertical direction, and a convergence force thereby strongly influences the electron beam in its horizontal direction.

[Sixth Preferred Embodiment]

Figure 15:
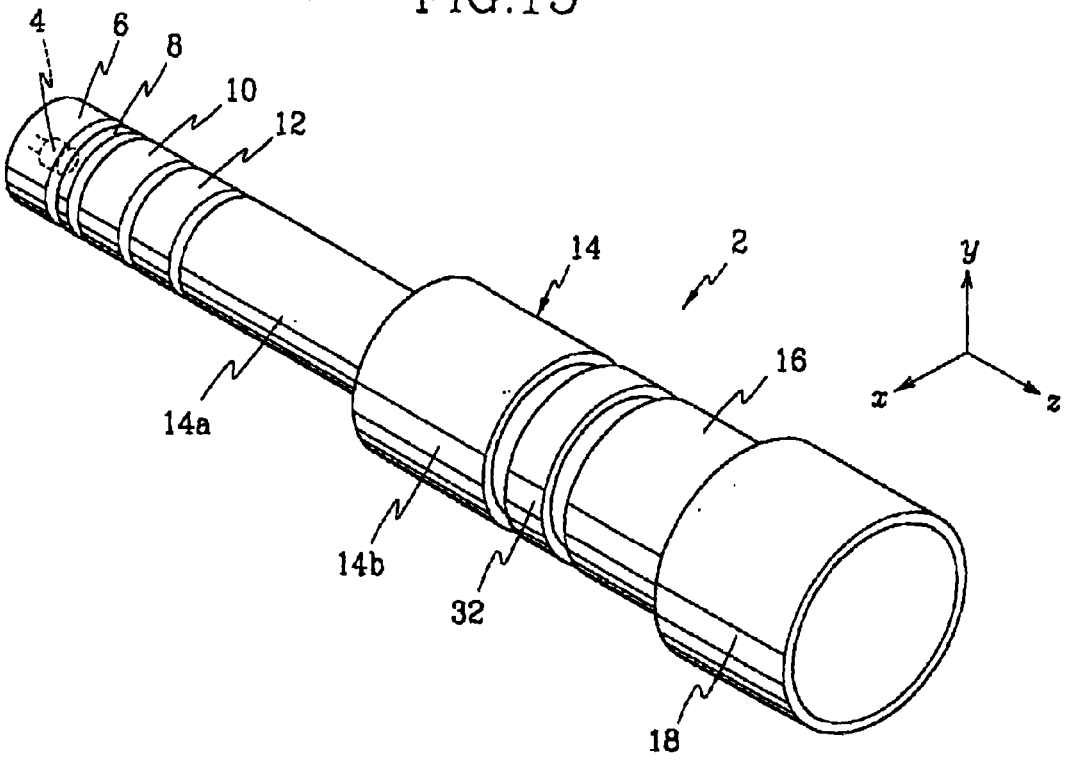
FIG. 15 is a schematic perspective view of an electron gun for a cathode ray tube according to a sixth preferred embodiment of the present invention.
Figure 16:
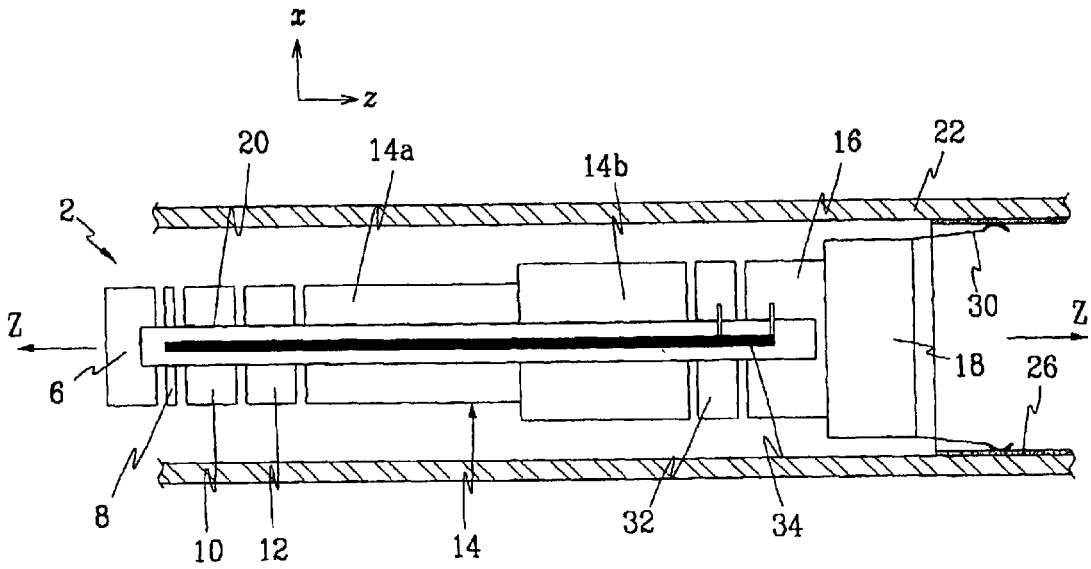
FIG. 16 is a plan view of the electron gun of FIG. 15 in a state mounted in a neck of a cathode ray tube.
Figure 17:
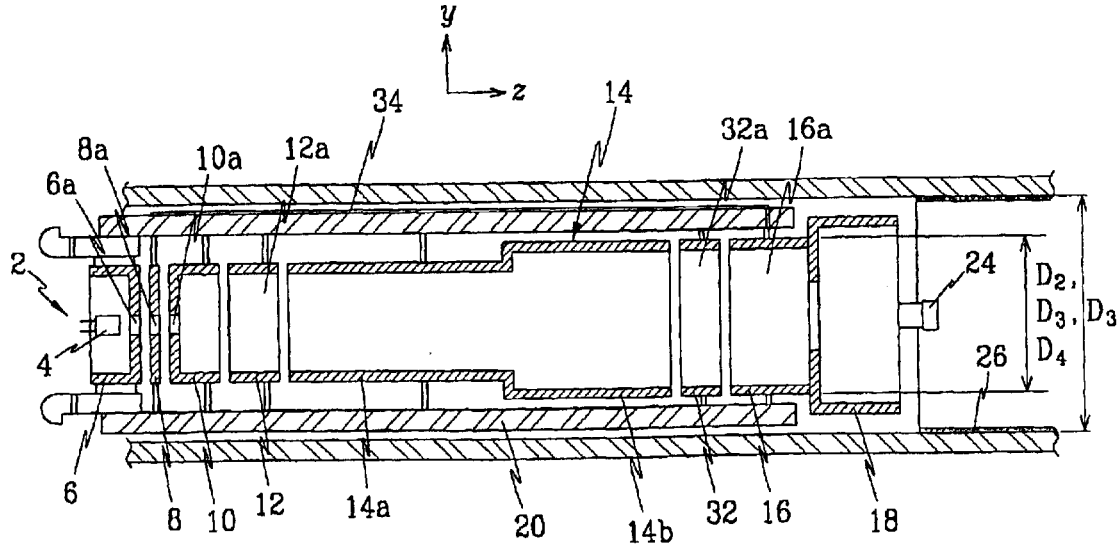
FIG. 17 is a side sectional view of the electron gun of FIG. 16.

FIG. 15 is a schematic perspective view of an electron gun for a cathode ray tube according to a sixth preferred embodiment of the present invention, FIG. 16 is a plan view of the electron gun of FIG. 15 in a state mounted in a neck of a cathode ray tube, and FIG. 17 is a side sectional view of the electron gun of FIG. 16.

The electron gun 2 of the sixth preferred embodiment has the same basic structure as the preferred embodiments previously described. However, the electron gun 2 in this embodiment further includes an intermediate electrode 32 mounted between a final focus electrode 14 and an anode electrode 16.

The intermediate electrode 32 is cylindrical and hollow, and substantially identical in shape and size (in its cross section) to an output section 14*b* of the final focus electrode 14 and to the anode electrode 16. That is, inner and outer diameters of the intermediate electrode 32 are substantially identical to those of the output section 14*b* of the final focus electrode 14 and the anode electrode 16. With this configuration, the intermediate electrode 32 defines an electron beam aperture 32*a* of the same diameter as its inner diameter.

A voltage applied to the intermediate electrode 32 is greater than a voltage applied to the final focus electrode 14 and is less than a voltage applied to the anode electrode 16. In the sixth preferred embodiment of the present invention, the voltage applied to the intermediate electrode 32, with reference to FIG. 16, is supplied through a resistive member 34, which is formed along one side of a support 20 and connected to the intermediate electrode 32 and the anode electrode 16.

That is, the resistive member 34 has a specific resistance value (a few hundred MΩ (mega-ohms)~a few GΩ (giga-ohms)), which is used to reduce the voltage applied to the anode electrode 16 by a predetermined ratio before supply to the intermediate electrode 32. The resistance value of the resistive member 34 maybe easily varied by changing a length, cross section, etc. of the resistive member 34.

During operation of the electron gun 2 structured as in the above, the main lens formed between the final focus electrode 14 and the anode electrode 16 may be formed of equipotential lines that are distributed in a gentler slant by operation of the intermediate electrode 32. That is, the intermediate electrode 32 receives a voltage that is smaller than the voltage applied to the anode electrode 16 and greater than the voltage applied to the final focus electrode 14 as described above to thereby prevent an abrupt change in a potential difference between the anode electrode 16 and the final focus electrode 14. Therefore, the intermediate electrode 32 enables an increase in the size of the main lens formed between the final focus electrode 14 and the anode electrode 16.

Figure 18:
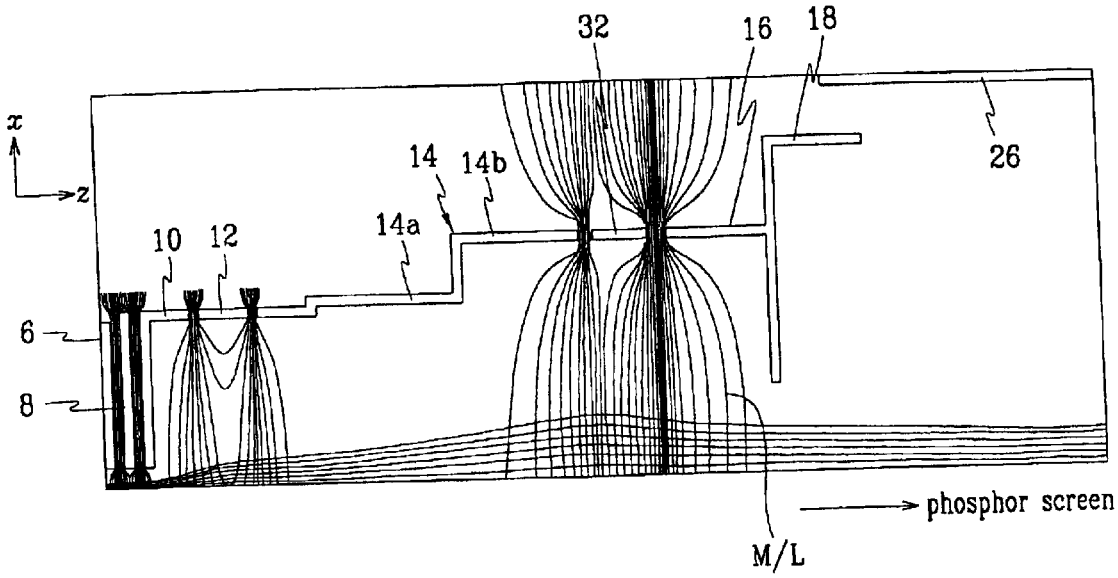
FIG. 18 shows results of a simulation indicating equipotential lines distributed on each electrode of an electron gun and indicating electron beam trajectory according to a sixth preferred embodiment of the present invention.

FIG. 18 shows results of a simulation indicating equipotential lines distributed on each electrode of the electron gun and indicating electron beam traces according to the sixth preferred embodiment of the present invention. The drawing is shown based on the X axis direction.

As shown in FIG. 18, the main lens M/L formed between the final focus electrode 14 and the anode electrode 16 is influenced by equipotential lines formed by the intermediate electrode 32 to increase in size between the final focus electrode 14 and the anode electrode 16. In this case, an aperture of the main lens M/L may be increased such that spherical aberration is reduced and electron beams landing on the phosphor screen have an even smaller horizontal diameter to thereby land on only intended phosphor layers.

In the sixth preferred embodiment of the present invention, the voltage applied to the intermediate electrode 32 preferably satisfies the following condition so that the above effect may be realized.

$$0.3\times V_b<V_m<0.6\times V_b \tag{9}$$

where $V_m$ is the voltage applied to the intermediate electrode 32 and $V_b$ is the voltage applied to the anode electrode 16.

Further, in the sixth preferred embodiment of the present invention, an outer diameter $D_2$ of the output section 14*b* of the final focus electrode 14 preferably satisfies Eq. (3) above, and the outer diameter $D_2$ of the output section 14*b*, an outer diameter $D_3$ of the anode electrode 16, and an outer diameter $D_5$ of the intermediate electrode 32 are substantially identical.

[Seventh Preferred Embodiment]

Figure 19:
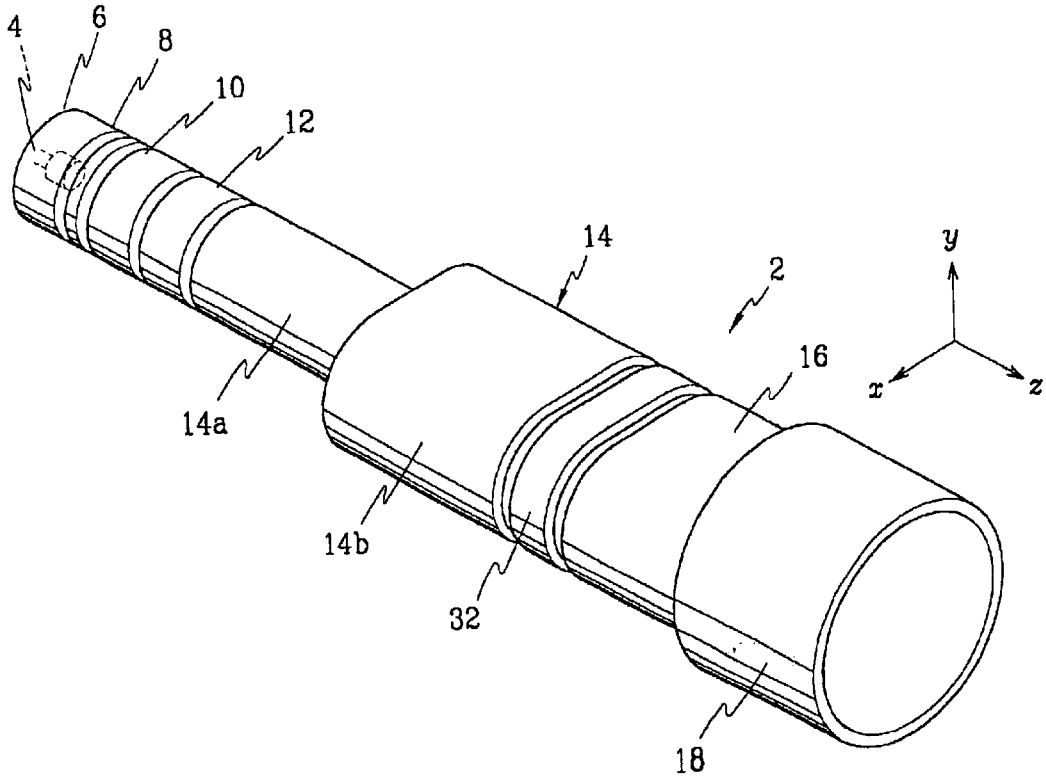
FIG. 19 is a schematic perspective view of an electron gun for a cathode ray tube according to a seventh preferred embodiment of the present invention.
Figure 20:
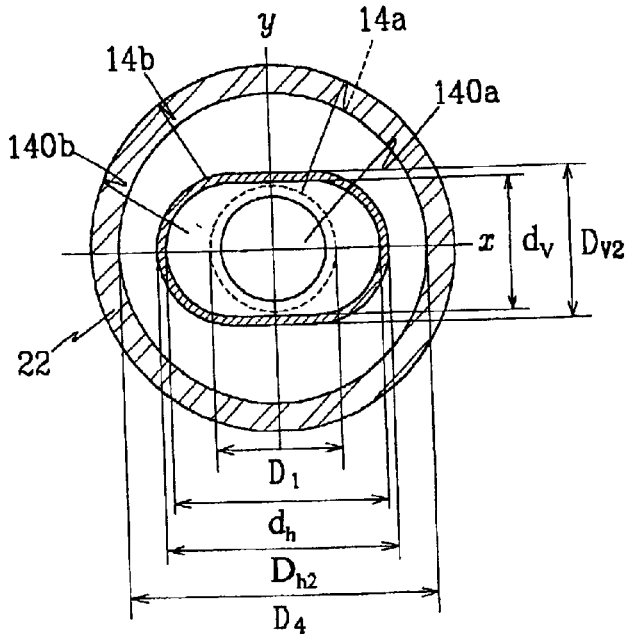
FIG. 20 is a sectional view of the electron gun of FIG. 19 used for illustrating a relation between input and output sections of a final focus electrode.
Figure 21:
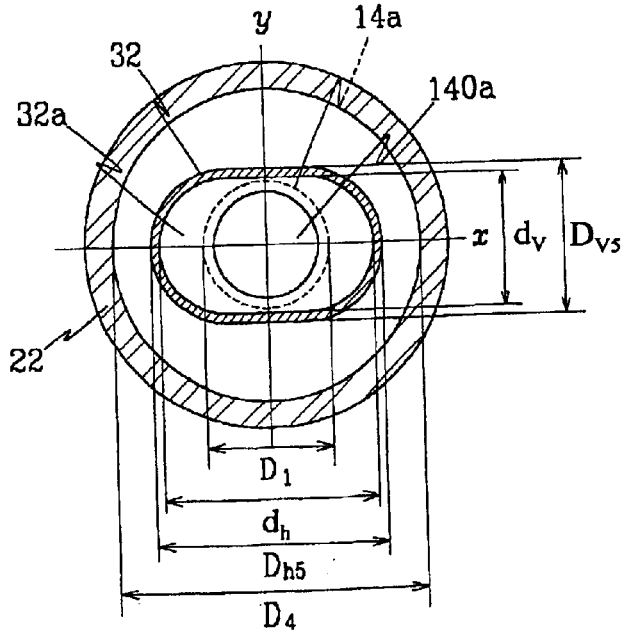
FIG. 21 is a sectional view of the electron gun of FIG. 19 used for illustrating a relation between a final electrode input section and an intermediate electrode.
Figure 22:
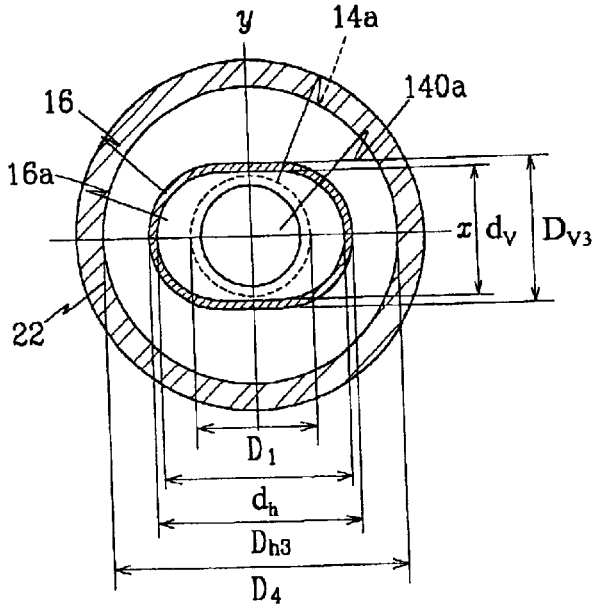
FIG. 22 is a sectional view of the electron gun of FIG. 19 used for illustrating a relation between an anode electrode and an input section of a final focus electrode.

FIG. 19 is a schematic perspective view of an electron gun for a cathode ray tube according to a seventh preferred embodiment of the present invention. FIGS. 20, 21, and 22 are sectional views of the electron gun of FIG. 19 in a state mounted in a neck of a CRT, where FIG. 20 is used for illustrating a relation between input and output sections of a final focus electrode, FIG. 21 is used for illustrating a relation between a final electrode input section and an intermediate electrode, and FIG. 22 is used for illustrating a relation between an anode electrode and an input section of a final focus electrode.

The electron gun 2 includes an intermediate electrode 32 mounted between a final focus electrode 14 and an anode electrode 16 as in the sixth preferred embodiment. An output section 14*b* of the final focus electrode 14, the anode electrode 16, and the intermediate electrode 32 are elliptical with horizontal major axes, that is, major axes in the X axis direction. Therefore, electron beam apertures 140*a*, 16*a*, and 32*a* defined by the output section 14*b*, the anode electrode 16, and the intermediate electrode 32, respectively, are also elliptical with major axes in the X axis direction.

With this structure, an input section 14*a* and the output section 14*b* of the final focus electrode 14 satisfy the condition presented below (see FIG. 20). Also, the intermediate electrode 32 and the anode electrode 16 have substantially the same cross-sectional dimensions as the output section 14*b* of the final focus electrode 14 (see FIGS. 21 and 22).

$$D_1<D_{v2}<D_{h2}<D_4 \tag{10}$$

where $D_1$ is an outer diameter of the input section 14*a* of the final focus electrode 14 in the X axis direction, $D_{v2}$ is an outer diameter in the Y axis direction of the output section 14*b* of the final focus electrode 14, $D_{h2}$ is an outer diameter in the X axis direction of the output section 14*b* of the final focus electrode 14, and $D_4$ is an inner diameter in the X axis direction of a neck 22 into which the electron gun 2 is inserted. Since the intermediate electrode 32 and the anode electrode 16 have substantially the same cross-sectional dimensions as the output section 14*b* of the final focus electrode 14, $D_{h2}$, the outer diameter in the X axis direction of the output section 14*b* of the final focus electrode 14, is substantially the same as $D_{h5}$, the outer diameter in the X axis direction of the intermediate electrode 32, and $D_{h3}$, the outer diameter in the X axis direction of the anode electrode 16. Further, $D_{v2}$, the outer diameter in the Y axis direction of the output section 14*b* of the final focus electrode 14, is substantially the same as $D_{v5}$, the outer diameter in the Y axis direction of the intermediate electrode 32, and $D_{V3}$, the outer diameter in the Y axis direction of the anode electrode 16.

In the electron gun 2 structured as in the above, the advantages obtained with respect to the third preferred embodiment are realized. That is, a diameter of a main lens in the X axis direction is increased to reduce a spherical aberration of the main lens (in the X axis direction). Therefore, electron beams landing on the phosphor screen have a small spot size in the horizontal direction to thereby land only on intended phosphor layers. To reduce the spherical aberration of the main lens, it is preferable that the following condition is satisfied.

$$1.2<d_h/d_v<1.8 \quad (11)$$

where $d_h$ is a horizontal diameter in the X axis direction of the electron beam apertures formed by the output section 14*b* of the final focus electrode 14, the intermediate electrode 32, and the anode electrode 16; and $d_v$ is a vertical diameter in the Y axis direction of the electron beam apertures formed by the output section 14*b* of the final focus electrode 14, the intermediate electrode 32, and the anode electrode 16.

[Eighth Preferred Embodiment]

Figure 23:
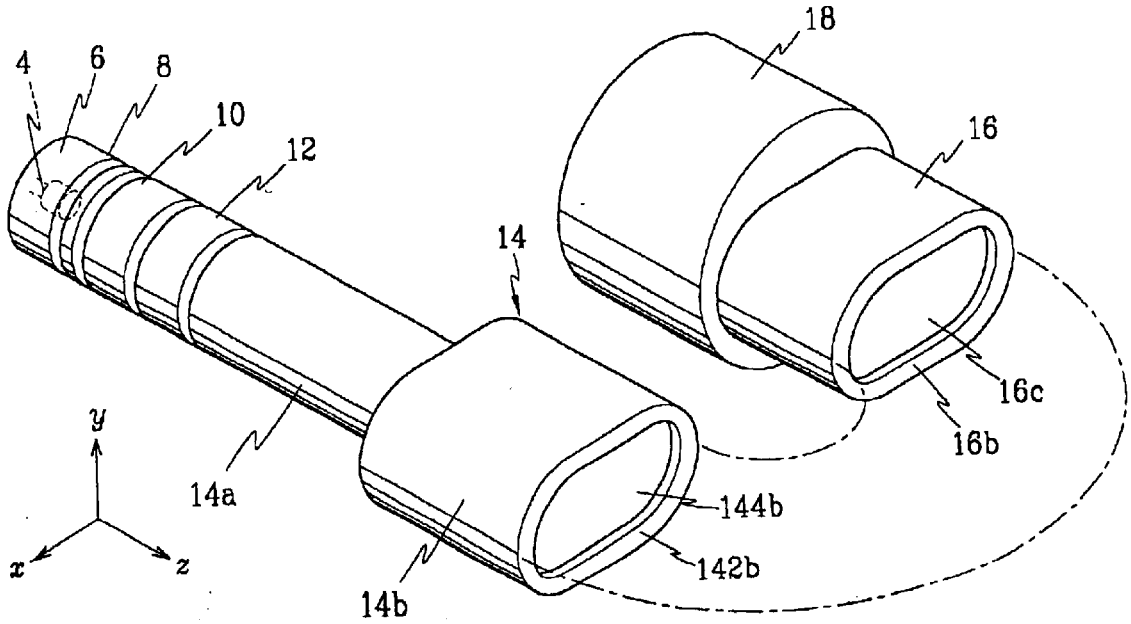
FIG. 23 is a schematic perspective view of an electron gun for a cathode ray tube according to an eighth preferred embodiment of the present invention.
Figure 24:
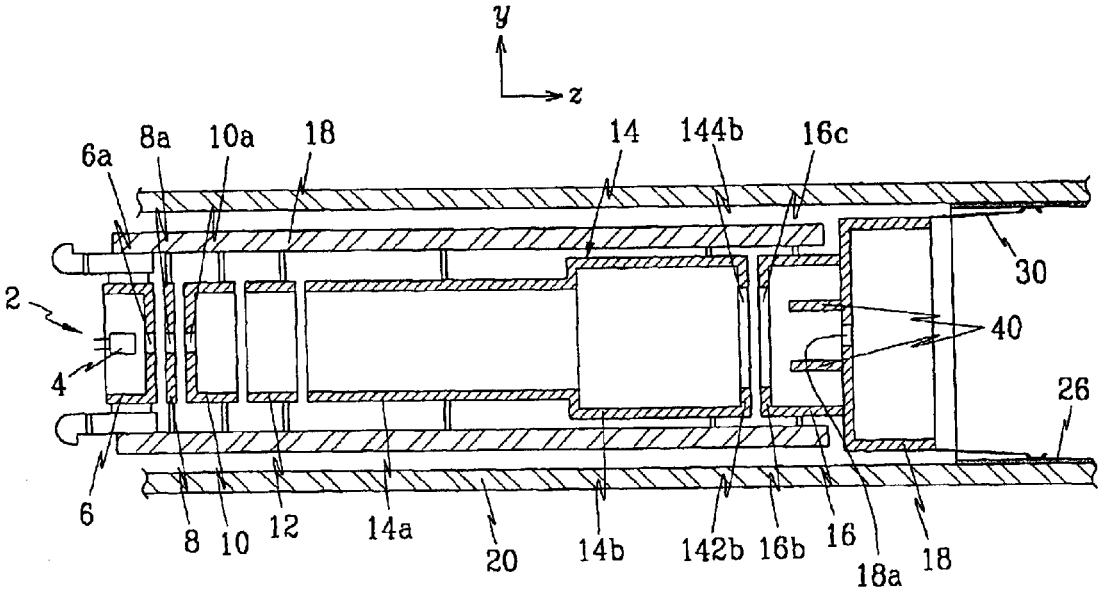
FIG. 24 is a sectional view of the electron gun of FIG. 23 in a state mounted in a neck of a cathode ray tube.

FIG. 23 is a schematic perspective view of an electron gun for a cathode ray tube according to an eighth preferred embodiment of the present invention, and FIG. 24 is a sectional view of the electron gun of FIG. 23 in a state mounted in a neck of a cathode ray tube.

The electron gun 2 is similar to the electron gun according to the seventh preferred embodiment. That is, cross sections of an output section 14*b* of a final focus electrode 14 and an anode electrode 16 are elliptical with major axes in the X axis direction.

Rims 142*b* and 16*b* are formed on opposing ends of the output section 14*b* of the final focus electrode 14 and the anode electrode 16, respectively. Also, electron beam apertures 144*b* and 16*c* are formed in the rims 142*b* and 16*b*, respectively. The electron apertures 144*b* and 16*c* are also elliptical with major axes in the X axis direction.

Figure 25:
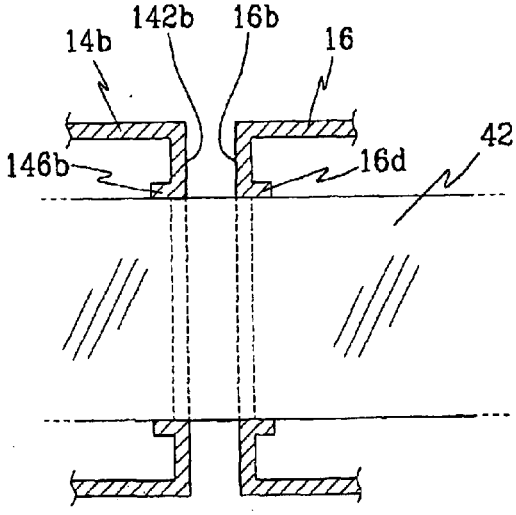
FIGS. 25, 27, 28, and 29 are sectional views used to describe modified examples of the electron gun according to the eighth preferred embodiment of the present invention.

Extensions 146*b* and 16*d*, with reference to FIG. 25, are formed at ends of the rims 142*b* and 16*b*, respectively. The extensions 146*b* and 16*d* follow a distal circumference of the rims 142*b* and 16*b*, respectively, and extend a predetermined distance respectively into the output section 14*b* and the anode electrode 16 along the Z axis direction.

The extensions 146*b* and 16*d* help during assembly of the electron gun 2. That is, during electron gun assembly, the extensions 146*b* and 16*b* allow the output section 14*b* and the anode electrode 16 to be evenly and easily slid onto and removed from a guide rod 42.

Figure 26:
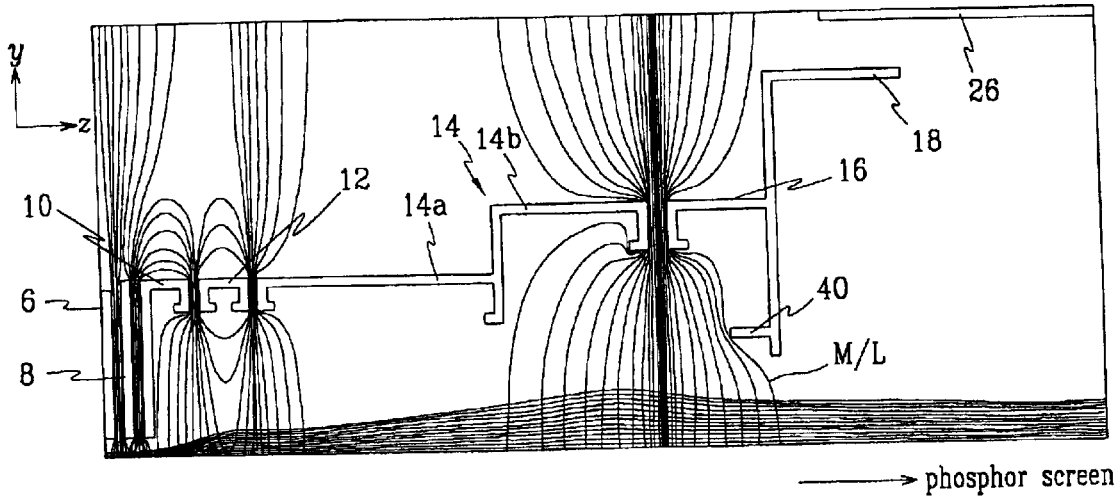
FIG. 26 shows results of a simulation indicating equipotential lines distributed on each electrode of an electron gun and indicating electron beam traces according to an eighth preferred embodiment of the present invention.

An electrode assembly 40 is formed on a shield cup 18 and extends into the anode electrode 16. During operation, the electrode assembly 40 affects a main lens formed between the output section 14*b* of the final focus electrode 14 and the anode electrode 16. FIG. 26 shows results of a simulation indicating equipotential lines distributed on each electrode of the electron gun 2 and indicating electron beam traces with respect to the electron gun 2 having the electrode assembly 40 and the extensions 146*b* and 16*d* formed in the rims 142*b* and 16*b* of the eighth preferred embodiment. The drawing is based on the Y axis direction.

With reference to the drawing, the main lens M/L formed between the final focus electrode 14 and the anode electrode 16 is influenced by equipotential lines formed by the electrode assembly 40 such that the main lens M/L is deformed, unlike in the preferred embodiments disclosed above. If the main lens M/L is deformed as shown, an astigmatism generated as a result is changed. With the change in the astigmatism, a spot size of electron beams landing on a phosphor screen may be varied to match characteristics of the CRT to which the electron gun 2 is applied.

The astigmatism may be increased be decreasing a width or increasing a length of electrodes of the electrode assembly 40 and by decreasing a distance between the electrodes of the electrode assembly 40. The astigmatism may be decreased, on the other hand, by changing these parameters in the opposite manner, that is, by increasing the width or decreasing the length of the electrodes of the electrode assembly 40 and by increasing the distance between the electrodes of the electrode assembly 40.

Figure 27:
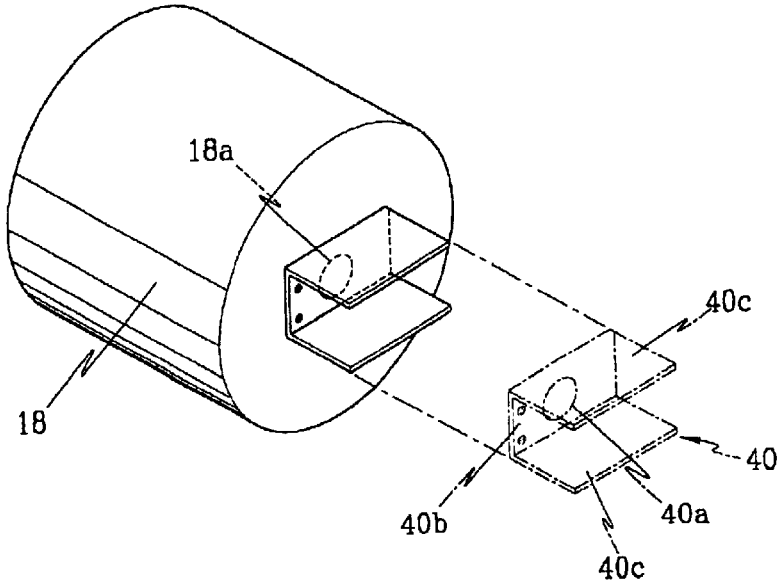
Figure 28:
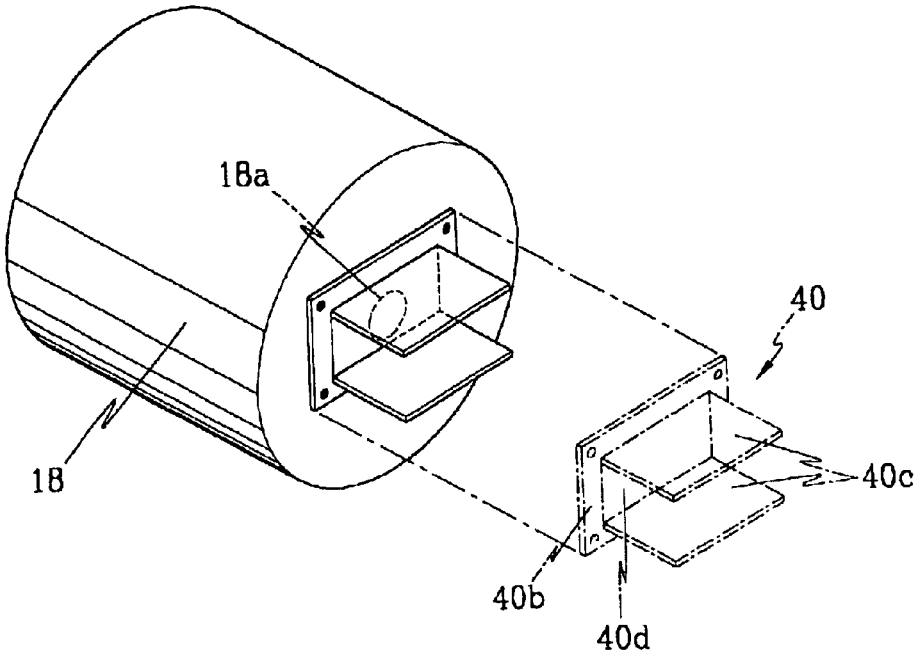
Figure 29:
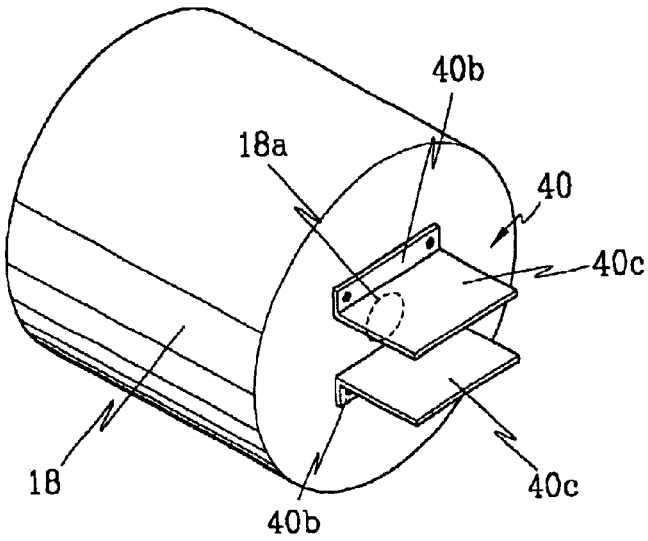

FIGS. 27, 28, and 29 are perspective views showing modified examples of the electrode assembly 40. First, as shown in FIG. 27, the electrode assembly 40 includes a fixing plate 40*b* that is fixedly mounted to the shield cup 18 and which has an electron beam aperture 40*a* corresponding to an electron beam aperture 18*a* of the shield cup 18, and horizontal plates 40*c* integrally formed to the fixing plate 40*b* and extending from opposite long sides of the same.

As shown in FIG. 28, the electrode assembly 40 includes a fixing plate 40*b* fixedly mounted to the shield cup 18 and having an elliptical hole 40*d* communicating with the electron beam aperture 18*a* of the shield cup 18. Also, horizontal plates 40*c* are integrally mounted on areas of the fixing plate 40*d* in a state contacting the hole 40*d* and opposing one another.

With reference to FIG. 29, the electrode assembly 40 includes a pair of fixing plates 40*b* fixedly (securely) mounted to the shield cup 18 to opposite sides of the electron beam aperture 18*a* of the shield cup 18, and horizontal plates 40*c* integrally formed along one of the long sides of each of the fixing plates 40*b* and extending a predetermined distance therefrom in a state normal to a surface of the shield cup 18 to which the fixing plates 40*b* are mounted.

[Ninth Preferred Embodiment]

In a ninth preferred embodiment of the present invention, the basic structure of the electron gun of the first preferred embodiment is used, and only electron beam apertures of first and second electrodes are altered. Therefore, for convenience in the following description, it is to be assumed that the structure provided above with respect to the first preferred embodiment (except that for the first and second embodiments) is also used for the ninth preferred embodiment.

Figure 30:
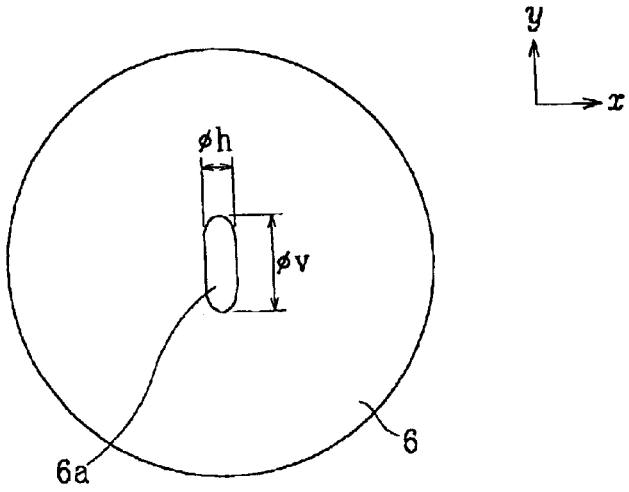
FIG. 30 is a perspective view of a first electrode of an electron gun for cathode ray tubes according to a ninth preferred embodiment of the present invention.

With reference to FIG. 30, in the ninth preferred embodiment of the present invention, an electron beam aperture 6*a* formed in a first electrode 6 is elliptical with a major axis in the Y axis direction. The major axis direction of the electron beam aperture 6*a*, that is, the Y axis direction, corresponds to a lengthwise direction of phosphor layers forming a phosphor screen of a CRT to which the electron gun is applied. The X axis direction indicated in the drawing is perpendicular to the Y axis direction.

Figure 31:
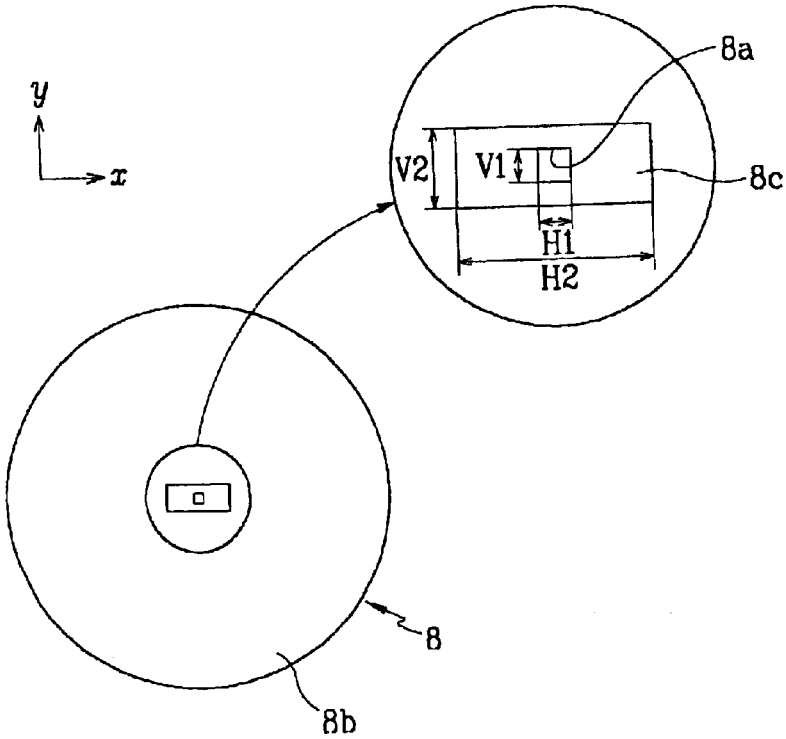
FIGS. 31 and 32 are front views of a second electrode of an electron gun for cathode ray tubes according to a ninth preferred embodiment of the present invention.
Figure 32:
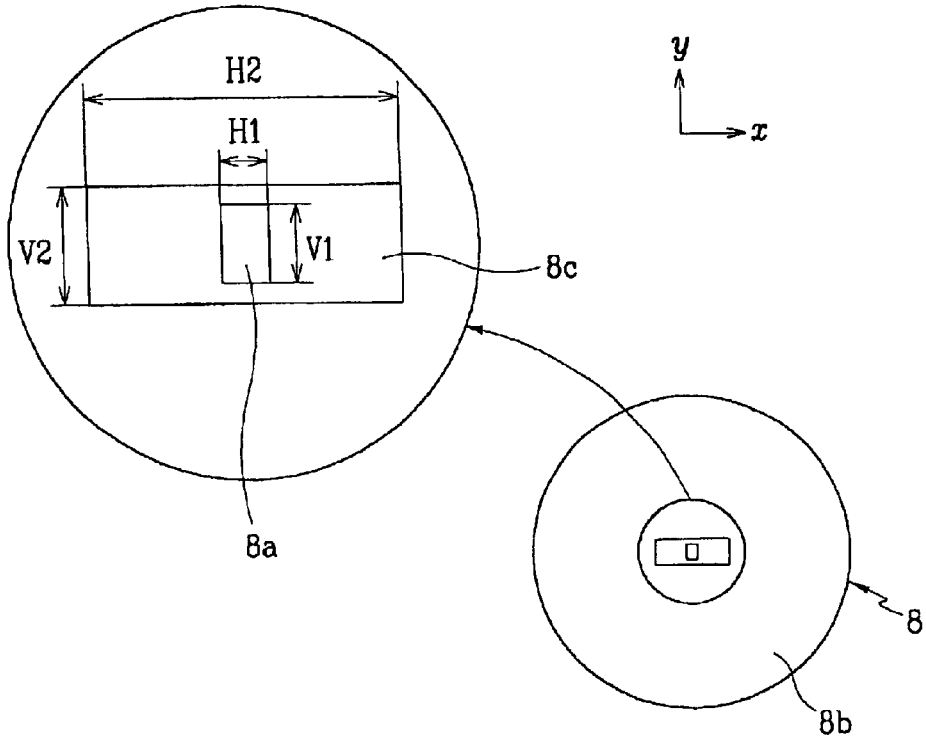

An electron beam aperture 8*a* of a second electrode 8, with reference to FIG. 31, is quadrilateral. The electron beam aperture 8*a* is formed in a slot 8*c*, which, in turn, is formed on a surface 8*b* of the second electrode 8 facing a first focus electrode 10. The electron beam aperture 8*a* of the second electrode 8 may be equilateral as shown in FIG. 31, or may be rectangular as shown in FIG. 32. The slot 8*c* is rectangular with long sides in the X axis direction. Further, in the ninth preferred embodiment of the present invention, the electron beam apertures 6*a* and 8*a*, and the slot 8*c* of the first and second electrodes 6 and 8 satisfy the conditions as outlined below.

First, with respect to the electron beam aperture 6*a* of the first electrode 6, if its X axis diameter is $\phi h$ and its Y axis diameter is $\phi v$, $\phi v$ is 2.2 to 2.5-times $\phi h$. Preferably, $\phi h$ satisfies the following condition and $\phi v$ is set based on this size limitation of $\phi h$.

$$0<\phi h\leqq 0.3 \text{ mm (millimeters)} \quad (12)$$

With respect to the electron beam aperture 8*a* of the second electrode 8, if its X axis diameter is H1 and its Y axis diameter is V1, V1 is 1.0 to 1.5-times H1. Preferably, H1 satisfies the following condition and V1 is set based on this size limitation of H1.

$$0<H1\leqq 0.6 \text{ mm} \quad (13)$$

Further, with respect to the slot 8*c* of the second electrode 2, if its horizontal length is H2 and its vertical length is V2, H2 is 2.5 to 6-times V2. Further, the vertical length V2 of the slot 8*c* may be identical to or larger than the Y axis diameter V1 of the electron beam aperture 8*a* of the second electrode 8. FIGS. 31 and 32 show the case where the vertical length V2 of the slot 8*c* is larger than the Y axis diameter V1 of the electron beam aperture 8*a* of the second electrode 8.

The slot 8*c* of the second electrode 8 may be integrally formed with the electron beam aperture 8*a* in accordance with the integral formation of the second electrode 8. Alternatively, the second electrode 8 may be structured by connecting one sub-electrode, to which the electron beam aperture 8*a* is formed, to another sub-electrode, to which the slot 8*c* is formed, such that the slot 8*c* is separated from the electron beam aperture 8*a*.

The first and second electrodes 6 and 8 structured as in the above receive voltages through stem pins (not shown), and by a difference in potential with the cathode 4, thermions emitted from the cathode 4 are pre-focused to form electron beams.

Figure 33:
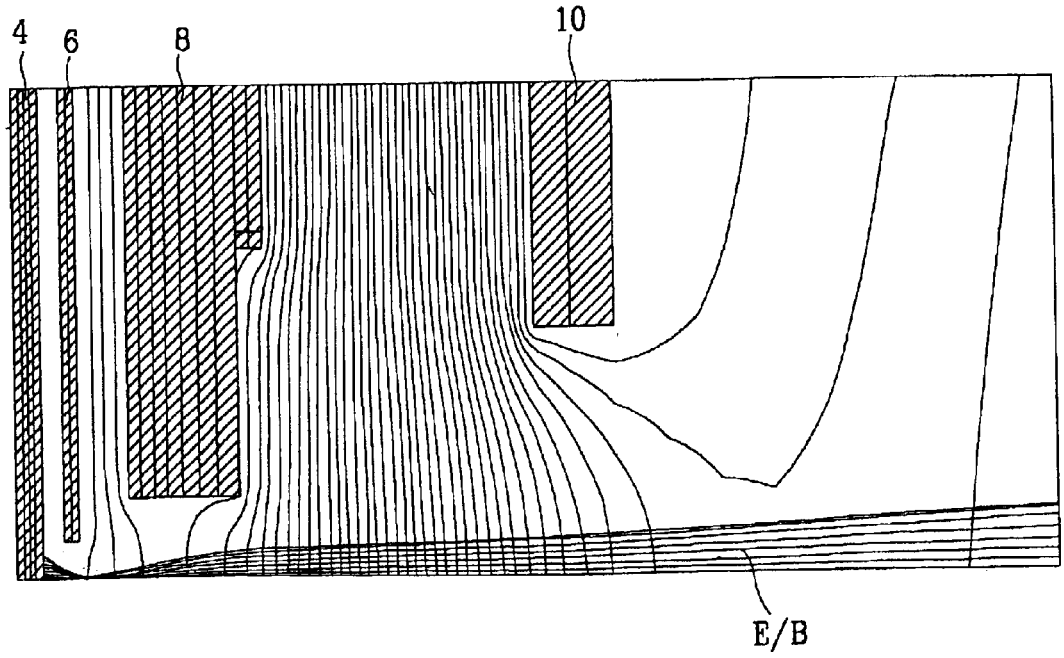
FIGS. 33 and 34 show results of a simulation indicating equipotential lines distributed on each electrode of an electron gun and indicating electron beam trajectory according to a ninth preferred embodiment of the present invention, where
Figure 34:
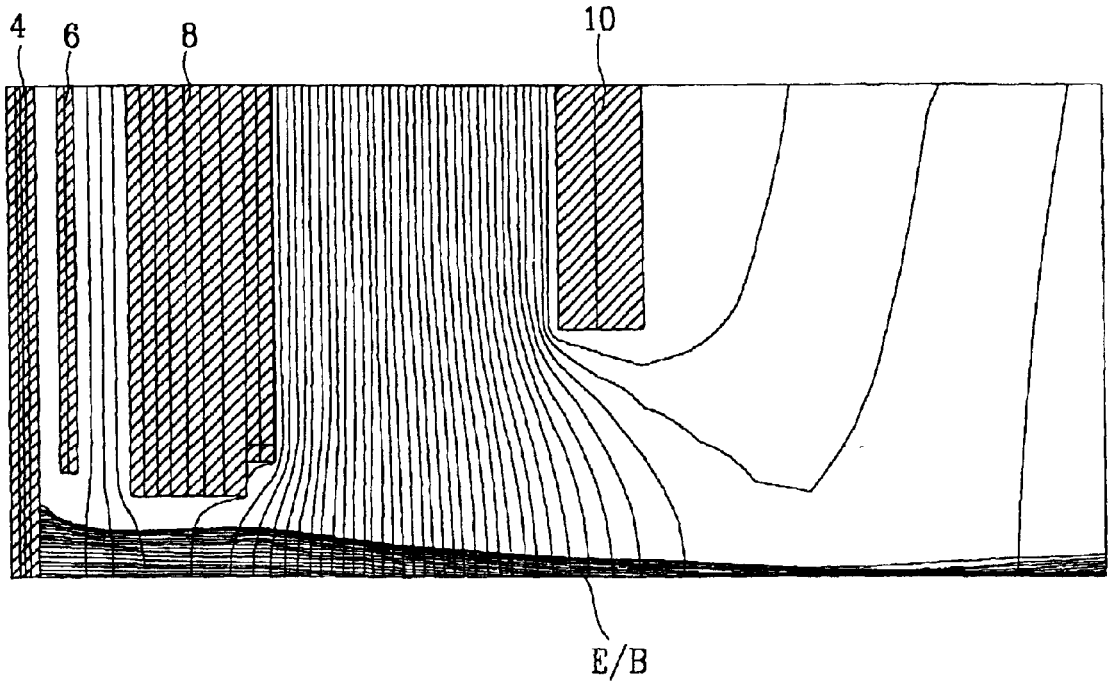

In the electron gun including the first and second electrodes 6 and 8 structured as in the above, a horizontal spot size of the electron beams landing on the phosphor screen may be made extremely small, as is evident from FIGS. 33 and 34.

FIGS. 33 and 34 show results of a simulation indicating equipotential lines distributed on each electrode of the electron gun and indicating electron beam traces according to the ninth preferred embodiment of the present invention, where FIG. 33 is based on an X axis direction and FIG. 34 is based on a Y axis direction. For convenience, only half of the electrodes and mostly a triode area of the electron gun are shown.

As shown in the drawings, the amount of electrons emitted from the cathode 4 is small in the X axis direction (see FIG. 33) but large in the Y axis direction (see FIG. 34). At this time, cross over of electron beams E/B occurs at areas close to the cathode 4 and the first focus electrode 10.

Cross over characteristics of the electron beams E/B, particularly, cross over characteristics of the electron beams E/B in the Y axis direction are such that when the electron beams E/B are deflected by a deflection magnetic field of a deflection device (not shown) to land on the phosphor screen, the electron beams E/B are over focused in the Y axis direction such that a halo is not formed. As a result, the electron beams E/B formed by operation of the electron gun 2 land on the phosphor screen having a minute spot size in the X axis direction.

Figure 35:
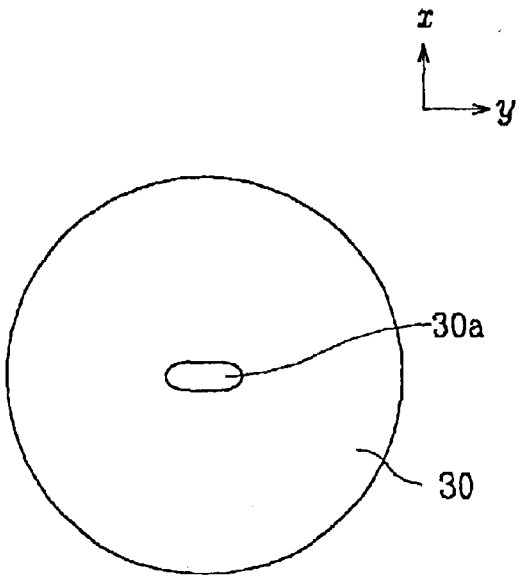
FIGS. 35, 36, and 37 are front views used to describe modified examples of the first and second electrodes according to the ninth preferred embodiment of the present invention.
Figure 36:
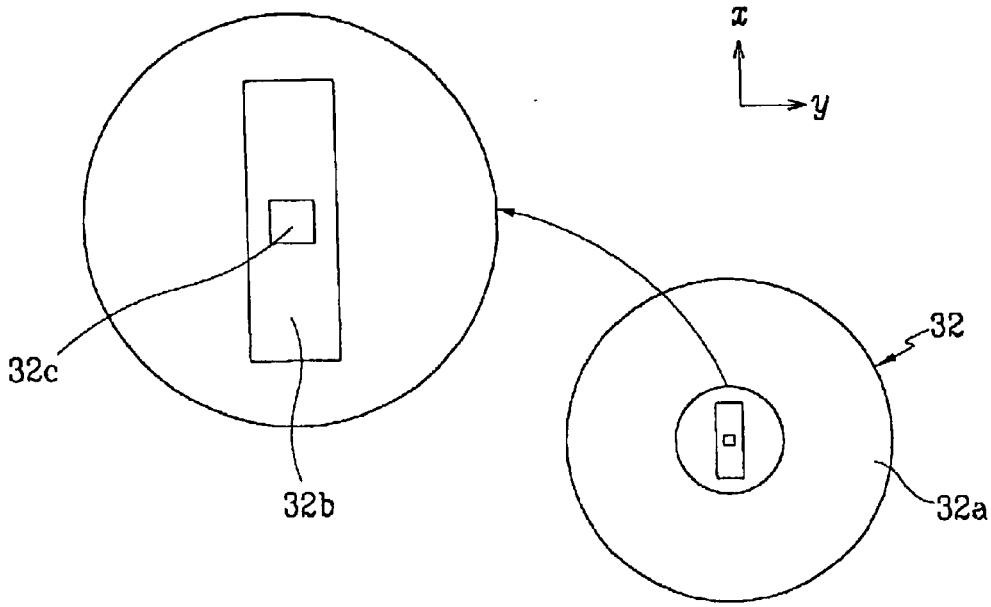
Figure 37:
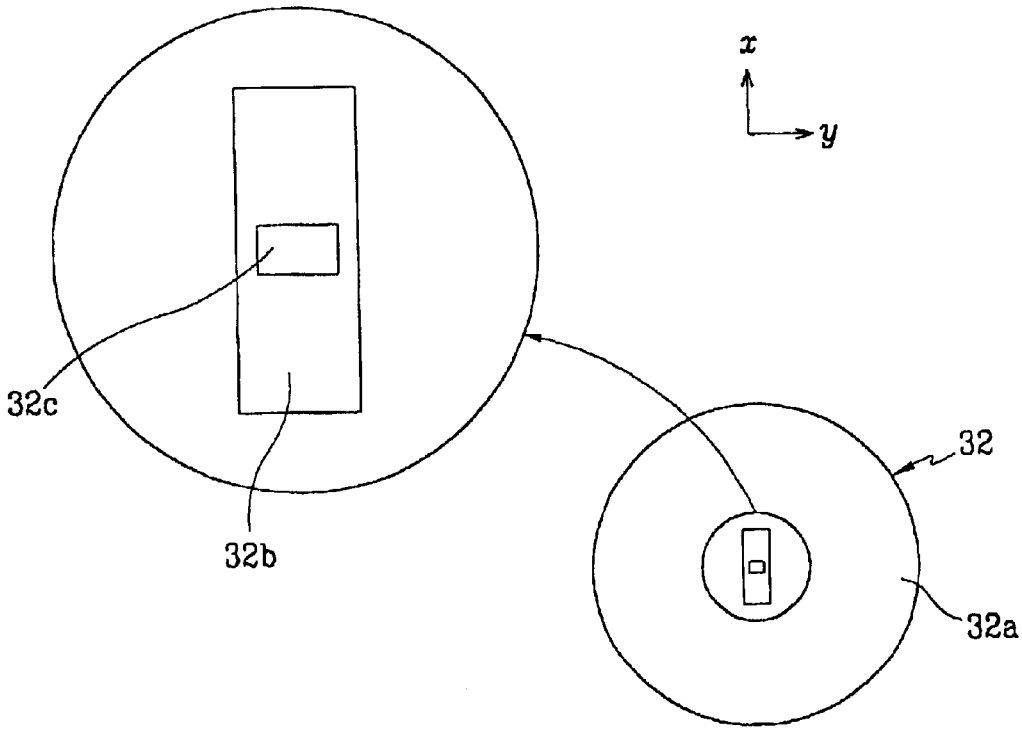
Figure 38:
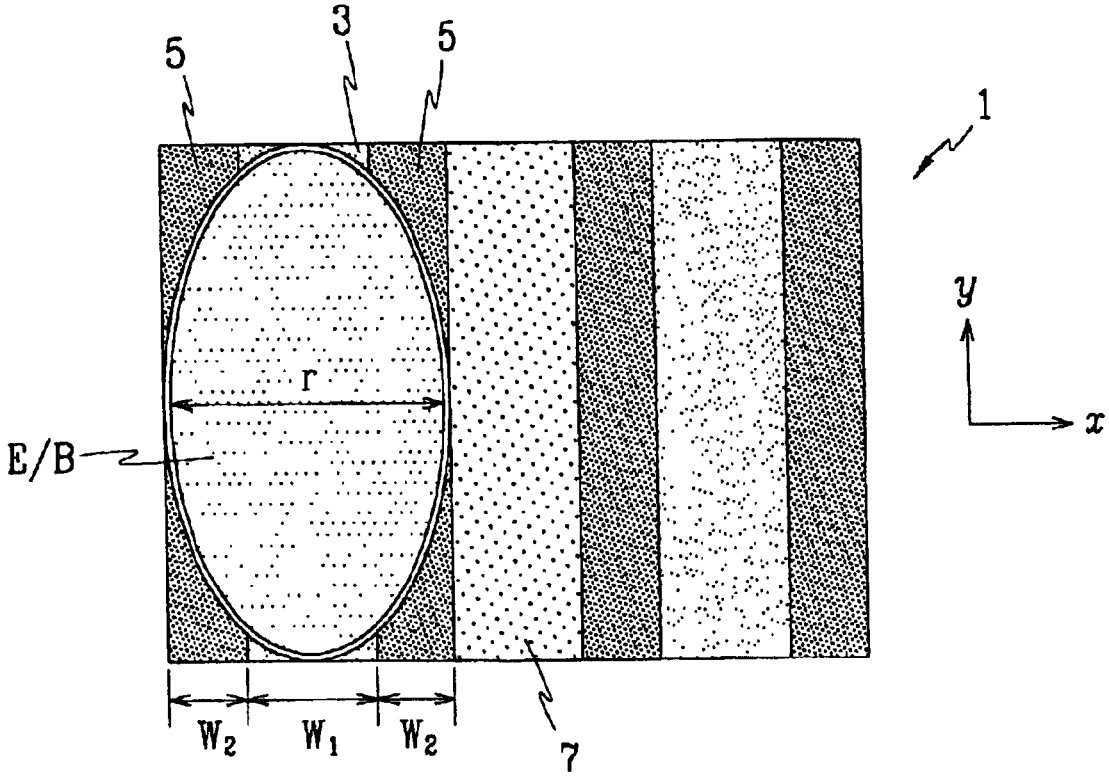
FIG. 38 is a partially enlarged view of a phosphor screen of a conventional beam index cathode ray tube illustrating landing of an electron beam.

FIGS. 35, 36, and 37 show modified examples of first and second electrodes of the ninth preferred embodiment of the present invention, where FIG. 35 is a front view of a modified example of the first electrode, and FIGS. 36 and 37 are front views of modified examples of the second electrode.

An electron gun including the first and second electrodes according to these modified examples may be applied to a CRT, in which lengths of phosphor layers forming a phosphor screen are provided in the Y axis direction (or horizontal direction) in FIGS. 35 and 36. Accordingly, these modified examples may be viewed as being reciprocals of the above preferred embodiments, that is, cases where the electron gun has been rotated 90 degrees in the clockwise or counterclockwise direction.

In more detail, a first electrode 30 according to this modified example, as shown in FIG. 35, includes an electron beam aperture 30*a* that is elliptical with a major axis in the Y axis direction. A second electrode 32, as shown in FIGS. 36 and 37, includes a slot 32*b* that is formed on a surface thereof opposing the first electrode 30, in which the slot 32*b* is rectangular with long sides in the X axis direction. A quadrilateral electron beam aperture 32*c* is formed in the slot 32*b*. The electron beam aperture 32*c* may be equilateral (see FIG. 36) or rectangular with long sides in the Y axis direction (see FIG. 37).

An electron gun including the above first and second electrodes 30 and 32 maybe applied to a CRT, in which lengths of phosphor layers forming the phosphor screen are provided in the Y axis direction. As with the above preferred embodiment, during operation, cross over with respect to vertical components of the electron beams occurs at areas in the vicinity of the focus electrode such that the electron beams landing on the phosphor screen are over focused in the Y axis direction so that a halo is not formed. As a result, the electron beams land on the phosphor screen in a state having a minute spot size in the X axis direction (or vertical direction).

In the electron gun of the present invention structured and operating as in the above, the main lens is optimized with respect to aperture size such that a horizontal spot size of the electron beams landing on the phosphor screen is made extremely small. As a result, the electron gun is suitable for application to a beam index CRT. Also, with the separated (i.e., non-overlapping), simple structure of the final focus electrode and the anode electrode, which form the main lens, design and manufacture are made easy, and eddy currents are prevented from generating between the final focus electrode and anode electrode as in the earlier art. Hence, with respect to this last advantage of the present invention, a reduction in focusing characteristics caused by the eddy currents during operation does not occur.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted directly opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in an area of the anode electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode.

2. The electron gun of claim 1, wherein the electron beam aperture formed in the portion of the final focus electrode opposing the anode electrode, and the electron beam aperture formed in the area of the anode electrode opposing the final focus electrode have diameters in the X axis and Y axis directions that are larger than diameters in the X axis and Y axis directions of the electron beam apertures formed in the electrodes between the cathode and the final focus electrode.

3. The electron gun of claim 1, wherein the electron beam aperture formed in the portion of the final focus electrode opposing the anode electrode, and the electron beam aperture formed in an area of the anode electrode opposing the final focus electrode are substantially circular in cross section.

4. The electron gun of claim 1, wherein the electron beam aperture formed in the portion of the final focus electrode opposing the anode electrode, and the electron beam aperture formed in the area of the anode electrode opposing the final focus electrode are substantially identical in diameter in the X axis direction.

5. The electron gun of claim 1, wherein the final focus electrode includes an input section that is positioned on one side of the final focus electrode extending toward the cathode and an output section that is positioned on an opposite side of the final focus electrode extending toward the anode electrode, where a maximum inner diameter in the X axis direction of the output section is larger than a maximum inner diameter in the X axis direction of the input section.

6. The electron gun of claim 5, wherein the final focus electrode satisfies the following condition, $$D_1<D_2<D_4$$

where $D_1$ is an outer diameter in the X axis direction of the input section of the final focus electrode, $D_2$ is an outer diameter in the X axis direction of the output section of the final focus electrode, and $D_4$ is an inner diameter in the X axis direction of a neck of the cathode ray tube into which the electron gun is inserted, the outer diameters being the outer most diameters of the final focus electrode at the output and input sections taken in the X axis direction.

7. The electron gun of claim 5, wherein the final focus electrode and the anode electrode satisfy the following condition, $$D_1<D_3<D_4$$

where $D_1$ is an outer diameter in the X axis direction of the input section of the final focus electrode, $D_3$ is an outer diameter in the X axis direction of the anode electrode, and $D_4$ is an inner diameter in the X axis direction of a neck of the cathode ray tube into which the electron gun is inserted, the outer diameters being the outer most diameters of the final focus electrode at the input section and the anode electrode taken in the X axis direction.

8. The electron gun of claim 5, wherein the input section and the output, section have external shapes that are substantially circular in cross section.

9. The electron gun of claim 1, wherein rims are formed in the electron beam aperture formed in the portion of the final focus electrode opposing the anode electrode, and in the electron beam aperture formed in the area of the anode electrode opposing the final focus electrode.

10. The electron gun of claim 1, further comprising:

a shield cup including a main surface through which an electron beam aperture is formed, the main surface contacting the anode electrode; and a plate electrode assembly having a pair of plate electrodes that are formed at a predetermined spacing on the main surface with the electron beam aperture provided between the plate electrodes, the plate electrodes extending into the anode electrode.

11. The electron gun of claim 10, wherein the plate electrode assembly comprises:

a fixing plate fixedly mounted to the shield cup and including an elliptical hole communicating with the electron beam aperture of the shield clip; and the plate electrodes integrally mounted on edges of the fixing plate in a state contacting the hole and opposing one another.

12. The electron gun of claim 10, wherein the plate electrode assembly comprises:

a pair of fixing plates fixedly mounted to the shield cup to opposite sides of the electron beam aperture of the shield cup; and the plate electrodes integrally formed along one of the long sides of each of the fixing plates in a state opposing one another.

13. The electron gun of claim 1, wherein the electron beam aperture formed in the first electrode is approximately elliptical, the electron beam aperture formed in the second electrodes is quadrilateral, and a slot is formed in a surface of the second electrode facing the focus electrodes, the slot being formed lengthwise in the X axis direction.

14. The electron gun of claim 13, wherein the electron beam aperture of the second electrode is equilateral.

15. The electron gun of claim 13, wherein the electron beam aperture of the second electrode is rectangular with long sides in the Y axis direction.

16. An electron mm for a cathode ray tube, comprising:

a signal cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction on perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, wherein the final focus electrode includes an input section that is positioned on one side extending toward the cathode and an output section that is positioned on an opposite side extending toward the anode electrode, wherein the final focus electrode satisfies the following condition, $$D_1<D_2<D_4$$

where $D_1$ is an outer diameter in the X axis direction of the input section of the final focus electrode, $D_2$ is an outer diameter in the X axis direction of the output section of the final focus electrode, and $D_4$ is an inner diameter in the X axis direction of a neck of the cathode ray tube into which the electron gun is inserted, wherein $D_2$ and $D_4$ satisfy the following condition, $$D_2<0.65\times D_4.$$

17. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, wherein the final focus electrode includes an input section that is positioned on one side extending toward the cathode and an output section that is positioned on an opposite side extending toward the anode electrode, wherein the final focus electrode and the anode electrode satisfy the following condition, $$D_1<D_3<D_4$$

where $D_1$ is an outer diameter in the X axis direction of the input section of the final focus electrode, $D_3$ is an outer diameter in the X axis direction of the anode electrode, and $D_4$ is an inner diameter in the X axis direction of a neck of the cathode ray tube into which the electron gun is inserted, wherein $D_3$ and $D_4$ satisfy the following condition, $$D_3<0.65\times D_4.$$

18. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, wherein rims are formed in the electron beam aperture formed in the portion of the final focus electrode opposing the anode electrode, and in the electron beam aperture formed in the area of the anode electrode opposing the final focus electrode, wherein the electron beam aperture formed in the portion of the final focus electrode opposing the anode electrode, and the electron beam aperture formed in the area of the anode electrode opposing the final focus electrode are substantially elliptical with major axes in the X axis direction.

19. The electron gun of claim 18, wherein the electron beam aperture formed in the portion of the final focus electrode opposing the anode electrode, and the electron beam aperture formed in the area of the anode electrode opposing the final focus electrode are larger in diameter in the X and Y axes directions than the electron beam apertures formed in the electrodes between the cathode and the final focus electrode.

20. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam anertures formed in the electrodes between the cathode and the final focus electrode, wherein the final focus electrode includes an input section that is positioned on one side extending toward the cathode and an output section that is positioned on an opposite side extending toward the anode electrode, where an inner diameter in the X axis direction of the output section is larger than an inner diameter in the X axis direction of the input section, wherein the input section has a substantially circular external shape in cross section, and the output section has a substantially elliptical outer shape in cross section.

21. The electron gun of claim 20, wherein the final focus electrode satisfies the following condition, where $D_1$ is an outer diameter of the input section of the final focus electrode, $D_{v2}$ is an outer diameter of the output section of the final focus electrode in the Y axis direction, $D_{h2}$ is an outer diameter of the output section of the final focus electrode in the X axis direction, and $D_4$ is an inner, diameter in the X axis direction of a neck of the cathode ray tube into which the electron gun is inserted.

22. The electron gun of claim 21, wherein the final focus electrode satisfies the following condition, $$D_{h2} \leqq 0.95 \times D_4.$$

23. The electron gun of claim 20, wherein the final focus electrode and the anode electrode satisfy the following concition, $$D_1 < D_{v3} < D_{h3} < D_4$$

where $D_1$ is an outer diameter of the input section of the final focus electrode, $D_{y3}$ is an outer diameter of the anode electrode in the Y axis direction, $D_{h3}$ is an outer diameter of the anode electrode in the X axis direction, and $D_4$ is an inner diameter in the X axis direction.

24. The electron gun of claim 23, wherein the anode electrode satisfies the following condition, $$D_{h2} \leqq 0.95 \times D_4.$$

25. The electron gun of claim 24, further comprising an intermediate electrode mounted between the final focus electrode and the anode electrode with a predetermined gap between the intermediate electrode and the final focus electrode and between the intermediate electrode and the anode electrode, the intermediate electrode receiving a voltage that is greater than a voltage applied to the final focus electrode and less than a voltage applied to the anode electrode, wherein a diameter of an electron beam aperture formed in the intermediate electrode is larger than the diameters of the electron beam apertures formed in the electrodes between the cathode and the final focus electrode.

26. The electron gun claim 25, wherein the voltage is applied to the intermediate electrode through a resistive member, which is mounted along a length of one side of the support and connected to the intermediate electrode and the anode electrode.

27. The electron gun of claim 25, wherein the final focus electrode includes an input section that is positioned on one side extending toward the cathode and an output section that is positioned on an opposite side extending toward the intermediate electrode, an inner diameter of the output section being larger than an inner diameter of the input section, and the intermediate electrode including substantially identical inner and outer diameters as the output section of the final focus electrode and the anode electrode.

28. The electron gun of claim 27, wherein the electron beam apertures of the final focus electrode, the intermediate electrode, and the anode electrode are substantially circular in cross section.

29. An electron gun for a cathode ray tube, comprising:

a single cathode emitting thermions;

first and second electrodes formina a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that support the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, further comprising an intermediate electrode mounted between the final focus electrode and the anode electrode with a predetermined gap between the intermediate electrode and the final focus electrode and between the intermediate electrode and the anode electrode, the intermediate electrode receiving a voltage that is greater than a voltage applied to the final focus electrode and less than a voltage applied to the anode electrode, wherein a diameter of an electron beam aperture formed in the intermediate electrode is larger than the diameters of the electron beam apertures formed in the electrodes between the cathode and the final focus electrode, wherein the voltage applied to the intermediate electrode satisfies the following condition, $$0.3 \times Y_b < V_m < 0.6 \times Y_b$$

where $V_m$ is the voltage applied to the intermediate electrode and $Y_b$ is the voltage applied to the anode electrode.

30. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers formina a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electronic beam aperture formed in an area of the anode electrode opposing the final focus electrode have diameters in the X axis direction that are larger than diameters in the X axis direction of electron beam apertures formed in the electrodes between the cathode and the final focus electrode, further comprising an intermediate electrode mounted between the final focus electrode and the anode electrode with a predetermined gap between the intermediate electrode and the final focus electrode and between the intermediate electrode and the anode electrode, the intermediate electrode receiving a voltage that is greater than a voltage applied to the final focus electrode and less than a voltage applied to the anode electrode, wherein a diameter of an electron beam aperture formed in the intermediate electrode is larger than the diameters of the electron beam apertures formed in the electrodes between the cathode and the final focus electrode, wherein the final focus electrode includes an input section that is positioned on one side extending toward the cathode and an output section that is positioned on an opposite side extending toward the intermediate electrode, an inner diameter of the output section being larger than an inner diameter of the input section, and the intermediate electrode including substantially identical inner and outer diameters as the output section of the final focus electrode and the anode electrode, wherein the electron beam apertures of the output section of the final focus electrode, the intermediate electrode, and the anode electrode are substantially elliptical with major axes in the X axis direction.

31. The electron gun of claim 30, wherein the electron beam apertures of the final focus electrode, the intermediate electrode, and the anode electrode have identical inner and outer diameters, and the final focus electrode, the intermediate electrode, and the anode electrode satisfy the following conditions, $$D_1<D_{V2}<D_{H2}<D_4 \text{ and } 1.2<d_h/d_v<1.8,$$

where $D_1$ is the outer diameter of the input section of the final focus electrode, $D_{v2}$ is the outer diameter in a vertical direction of the output section of the final focus electrode, $D_{h2}$ is the outer diameter in a horizontal direction of the output section of the final focus electrode, $D_4$ is an inner diameter in the X axis direction of a neck into which the electron gun is inserted, $d_h$ is a horizontal diameter of the electron beam apertures formed in the output section of the final focus electrode, the intermediate electrode, and the anode electrode, and d, is a vertical diameter of the electron beam apertures formed in the output section of the final focus electrode, the intermediate electrode, and the anode electrode.

32. An electron gun for a cathode ray tube, comprising:

a signal cathode emitting thermions;

first and second electrodes forming a triode structure with the cathode;

a plurality of focus electrodes orovided consecutively after the second electrode in a direction away from the cathode;

an anode electrode mounted after a final focus electrode, the final focus electrode being farthest from the cathode among the focus electrodes; and a support that supports the electrodes in an aliened configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, further comprising:

a shield cup including a main surface through which an electron beam aperture is formed, the main surface contacting the anode electrode; and a plate electrode assembly having a pair of plate electrodes that are formed at a predetermined spacing on the main surface with the electron beam aperture provided between the plate electrodes, the plate electrodes extending into the anode electrode, wherein rims are formed in the electron beam aperture formed in the portion of the final focus electrode opposing the anode electrode, and in the electron beam aperture formed in the area of the anode electrode opposing the final focus electrode, and extensions are formed following a distal circumference of the rims and extending a predetermined distance into the final focus electrode and the anode electrode.

33. An electron gun for a cathode ray tube, comprising:

a cathode emitting thermions;

first and second electrodes forming a triode structure with the cathode;

a plurality of focus electrodes provided consecutively after the second electrode in a direction away from the cathode; and an anode electrode mounted after a final focus electrode, the final focus electrode being farthest from the cathode among the focus electrodes, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, further comprising:

a shield cup including a main surface through which an electron beam aperture is formed, the main surface contacting the anode electrode; and a plate electrode assembly having a pair of plate electrodes that are formed at a predetermined spacing on the main surface with the electron beam aperture provided between the plate electrodes, the plate electrodes extending into the anode electrode, wherein the plate electrodes are mounted such that widths of the plate electrodes are in the X axis direction.

34. An electron gun for a cathode ray tube, comprising:

a single cathode emitting thermions;

first and second electrodes forming a triode structure with the cathode;

a plurality of focus electrodes orovided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam anertures formed in the electrodes between the cathode and the final focus electrode, further comprising:

a shield cup including a main surface through which an electron beam aperture is formed, the main surface contacting the anode electrode; and a plate electrode assembly having a pair of plate electrodes that are formed at a predetermined spacing on the main surface with the electron beam aperture orovided between the plate electrodes, the plate electrodes extending into the anode electrode, wherein the plate electrode assembly comprises:

a fixing plate fixedly mounted to the shield cup, the fixing plate including an electron beam aperture communicating with the electron beam aperture of the shield cup; and the plate electrodes integrally formed to the fixing plate and extending from opposite long sides of the same.

35. An electron gun for a cathode ray tube, comprising:

a single cathode emitting thermions;

first and second electrodes forming a triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, wherein the electron beam aperture formed in the first electrode is elliptical with a major axis in a vertical direction, the electron beam aperture formed in the second electrodes is quadrilateral, and a slot is formed in a surface of the second electrode facing the focus electrodes, the slot being formed lengthwise in a horizontal direction.

36. The electron gun of claim 35, wherein the electron beam aperture of the second electrode is equilateral.

37. The electron gun of claim 35, wherein the electron beam aperture of the second electrode is rectangular with long sides in a vertical direction.

38. The electron gun of claim 35, wherein when a short diameter and a long diameter of the electron beam aperture of the first electrode are $\Phi h$ and $\Phi v$, respectively, $\Phi v$ is 2.2 to 3.5 times $\Phi h$.

39. The electron gun of claim 38, wherein $\Phi h$ satisfies the following condition, $$0<\Phi h\leqq 0.3 \text{ mm.}$$

40. The electron gun of claim 35, wherein when a short diameter and a long diameter of the electron beam aperture of the first electrode are H1 and V1, respectively, V1 is 1.0 to 1.5 times H1.

41. The electron gun of claim 40, wherein H1 satisfies the following condition, $$0<H1\leqq 0.6 \text{ mm.}$$

42. The electron gun of claim 35, wherein when a horizontal length and a vertical length of the slot of the second electrode are H2 and V2, respectively, H2 is 2.5 to 6 times V2.

43. The electron gun of claim 42, wherein when a long diameter of the electron beam aperture of the second electrode is V2 and a long diameter of the electron beam aperture of the first electrode is V1, V2 is substantially identical to or greater than V1.

44. An electron gun for a cathode ray tube, comprising:

a single cathode emitting thermions;

first and second electrodes forming triode structure with the cathode;

a plurality of focus electrodes provided consecutively after the second electrode in a direction away from the cathode;

an anode electrode mounted after a final focus electrode, the final focus electrode being farthest from the cathode among the focus electrodes; and a support that supports the electrodes in an aligned configuration, the final focus electrode and the anode electrode are mounted opposing one another with a predetermined gap therebetween, and when a lengthwise direction of phosphor layers forming a phosphor screen of the cathode ray tube is referred to as a Y axis direction, and a direction perpendicular to the Y axis direction is referred to as an X axis direction, an electron beam aperture formed in a portion of the final focus electrode opposing the anode electrode, and an electron beam aperture formed in an area of the anode electrode opposing the final focus electrode have diameters in the X axis direction that are larger than diameters in the X axis direction of electron beam apertures formed in the electrodes between the cathode and the final focus electrode, wherein the electron beam aperture formed in the first electrode is elliptical with a major axis in a horizontal direction, the electron beam aperture formed in the second electrodes is quadrilateral, and a slot is formed in a surface of the second electrode facing the focus electrodes, the slot being formed lengthwise in a vertical direction.

45. The electron gun of claim 44, wherein the electron beam aperture of the second electrode is equilateral.

46. The electron gun of claim 44, wherein the electron beam aperture of the second electrode is rectangular with long sides in a horizontal direction.

* * * * *